US007534124B1

(12) United States Patent
Lemaire et al.

(10) Patent No.: US 7,534,124 B1
(45) Date of Patent: May 19, 2009

(54) METHOD AND APPARATUS FOR POWER OUTLET AND PLUG HAVING LOW-INSERTION-FORCE CONNECTOR

(75) Inventors: Charles A. Lemaire, Apple Valley, MN (US); Marian D. Maxwell, Renton, WA (US); Raymond Q. Draggie, Renton, WA (US); Scott D. Maxwell, Renton, MN (US)

(73) Assignee: Mechanical Answers LLC, Renton, WA (US)

( * ) Notice: Subject to any disclaimer, the term of this patent is extended or adjusted under 35 U.S.C. 154(b) by 0 days.

(21) Appl. No.: 11/685,753

(22) Filed: Mar. 13, 2007

Related U.S. Application Data

(60) Provisional application No. 60/782,041, filed on Mar. 13, 2006.

(51) Int. Cl.
*H01R 13/15* (2006.01)
*H01R 13/62* (2006.01)

(52) U.S. Cl. ..... 439/263; 439/270; 439/346

(58) Field of Classification Search ..... 439/263, 439/140, 343, 270, 269.2, 261, 260, 924.2, 439/370, 346
See application file for complete search history.

(56) References Cited

U.S. PATENT DOCUMENTS 2,261,615 A * 11/1941 Cornwell ..... 439/265
2,436,586 A * 2/1948 Mangold ..... 439/696
3,491,329 A * 1/1970 Lecocq ..... 439/263
3,763,459 A * 10/1973 Milis ..... 439/264
4,684,193 A * 8/1987 Havel ..... 439/259
4,775,335 A * 10/1988 Havel ..... 439/820
4,781,611 A * 11/1988 Leonard ..... 439/259
4,909,749 A * 3/1990 Long ..... 439/263
5,108,301 A * 4/1992 Torok ..... 439/263
5,197,897 A * 3/1993 Torok ..... 439/263
5,551,884 A * 9/1996 Burkhart, Sr. ..... 439/140
6,050,837 A * 4/2000 Duhe, Jr. ..... 439/270
6,171,129 B1 * 1/2001 Phillips ..... 439/346
6,832,925 B2 12/2004 Draggie et al.
6,910,252 B2 6/2005 Draggie et al.
7,182,615 B1 * 2/2007 Liu ..... 439/263

* cited by examiner

*Primary Examiner*—Hae Moon Hyeon
(74) *Attorney, Agent, or Firm*—Charles A. Lemaire; Lemaire Patent Law Firm, P.L.L.C.

(57) ABSTRACT

In some embodiments, the present invention provides an independently tightening collet surrounding each socket for each of a plurality of corresponding high-electrical-power prongs, wherein the collet is loosened for normal (low-insertion-force) insertion and withdrawal of the plug from the outlet. Once the plug is inserted, the collet is tightened, providing a high-contact force to lower the contact resistance and to help keep the plug from coming unplugged. In some embodiments, the plug is not "locked", in that a tension force pulling on the plug will overcome the contact force at a point before the plug or outlet is damaged, and the plug is allowed to come unplugged. In some embodiments, engaging the collet will also provide a wiping or sliding motion between the prong and socket for each connection, thus wiping at least some dirt or corrosion away and providing a lower-resistance better electrical contact.

17 Claims, 12 Drawing Sheets

Refer to Front View for other details of this connector. Clamping portion of Split ElectricalContact, Handle and feeder wires not shown.

600
630
620
99
LOOSEN
607
611
618
617
602
630
601
614
612
610
606
636
626
627
TIGHTEN

602'
636
606

VEHICLE BODY
99
630
601
620
626
627
611
617
614
612
610
607
609
609
610
612
618
611
617
608
RECEPTACLE
620
VEHICLE
626
627
99

602
636
POWER CORD
634
606
606
606
631
PLUG

METHOD AND APPARATUS FOR POWER OUTLET AND PLUG HAVING LOW-INSERTION-FORCE CONNECTOR

CROSS-REFERENCE TO RELATED APPLICATIONS

This invention claims benefit of U.S. Provisional Patent Application 60/782,041 filed Mar. 13, 2006, which is hereby incorporated by reference in its entirety.

FIELD OF THE INVENTION

This invention relates to the field of electric-power outlets, and more particularly to a method and apparatus for an electrical power outlet and mating plug having low- or zero-insertion force required, and having a contact-tightening mechanism to provide a highly reliable, low-resistance, high-current-capable, and/or lockable connection.

BACKGROUND OF THE INVENTION

Vehicles often need to obtain power (e.g., 110-volt or 220-volt AC, or sometimes 12 or 24-volt DC) from a land-based supply (e.g., by connection to the electrical utility power grid). Some conventional vehicles include a conventional 110-volt power cord running from the vehicle and having a conventional three-prong NEMA-standard plug on the end (National Electrical Manufacturers Association), which plug is inserted into a residential-type 110-volt outlet. Such a configuration has proved unsuitable or lacking for high-current needs, in that the plug can come unplugged or can have too little contact force, resulting in arc faults (where intermittent high-resistance contact is made, and where an arc across a small gap will form), which have a possible fire hazard for the vehicle and or docking facility.

Residential electrical circuitry originally used a "two-pole, two-wire, two-prong" configuration with each receptacle having a hot slot (also called the phase, line, or hot slot), and a neutral/ground slot. These receptacles did not have a separate equipment-grounding mechanism or connection. One pole is called the hot, phase, line, or hot wire, and the other pole is called the neutral. In the two-pole configuration, the neutral also served as a ground. A receptacle is a device with recessed male or female contacts that is part of an outlet typically installed in a wall or on equipment, and which is intended to establish electrical connection with, and provide power to, an inserted plug. A wall-mounted duplex outlet will have two receptacles. A plug is a device with male blades which, when inserted into a receptacle, establishes connection between the conductors of the attached flexible cord and the conductors connected to the receptacle. With the original "two-pole, two-wire" scheme, the only grounding point was at the service entrance, where the neutral (white) conductor was grounded. At some point, the NEMA (National Electrical Manufacturers Association) configuration 1-15R required that the receptacle slot for the neutral wire (typically having white-colored insulation) be longer than the slot for the hot wire (typically having black- or red-colored insulation), and that the blade of the neutral wire on the plug be wider than the hot blade, in order that it could not be inserted into the shorter hot slot. This enables certain types of equipment, like power-supply transformers and home appliances, to have their external metal parts or casing grounded through the white neutral wire connection. Such equipment uses a polarized plug where the neutral plug blade is wider than the hot plug blade, ensuring that it can only be inserted into a NEMA 1-15R configuration receptacle with the correct orientation.

Many modern residential and industrial power outlets and power plugs now have what is termed a two-pole, three-wire, three-prong design, which in the U.S. is typically used for conventional 120 V.A.C. (volts alternating current) convenience power outlets. Such power outlets typically include two receptacles and are known as duplex outlets. These configurations provide a separate ground wire from the receptacle that is typically connected to neutral and ground/earth at the residential circuit-breaker box. A modern three-prong power plug has three male blades or prongs that are typically nickel plated, tin, or brass, and that are inserted into three respective female slots or sockets of a wall receptacle. The prongs of the power plug and the female slots or sockets of the wall-mounted power receptacle vary in terms of size and shape based upon the purpose that they serve. One of the prongs (the "ground prong") is typically longer than the other two prongs, and in some embodiments is circular, semi-circular, or rounded in shape. Another of the prongs (the "neutral prong") has a blade that is slightly wider than the third prong's blade (the "hot prong"). Many power plugs are still made with only the hot and neutral prongs ("two-prong power plugs"), and omit the ground prong. Such two-prong plugs are often polarized, with the neutral blade wider than the hot blade. A three-socket power receptacle will accept either two-prong or three-prong power plugs.

Corresponding to the three male prongs of the plug are three female slots or sockets (i.e., the hot socket, neutral socket, and ground socket) of the power receptacle into which the plug's prongs are inserted. The power receptacle's sockets are designed to accommodate the size and length variations and allow either two-prong or three-prong power plugs to be inserted, while preventing or making it difficult to insert a two-prong plug the wrong way (e.g., with the neutral prong of the plug inserted into the hot socket of the power receptacle). The neutral socket of the power receptacle and the neutral prong of the plug are wider than the hot socket that accepts the hot prong, such that the neutral plug is too wide to be inserted into the hot socket. As an additional safety feature, the ground prong of the plug is typically made longer than either the hot prong or the neutral prong, in order that it makes contact with the power receptacle first. Correspondingly, the ground socket that accepts the ground prong is deeper than the other two sockets so as to accommodate the increased length of the ground prong.

One reason for the three-prong design, and in particular the use of a ground prong, is to provide an electrical ground that can be connected to the outside of a device, or its metal frame or chassis, such that a person who is standing on or otherwise connected to ground will not get a shock from the device if the hot power voltage or a portion thereof is connected to the device frame by accident damage, aged components, insulation degradation, impact, or wiring mistake. If the person and the outside of the device are both at a ground voltage, there will be no current flow when the person is touching the outside of the device.

Another reason for the three-prong design relates to the need to dissipate and/or direct ambient and non-ambient electrical charges. A system of interconnected electrical circuits, such as those found in the typical residential house, acts like a capacitive antenna that can either build up and/or conduct ambient and non-ambient electrical power found in the atmosphere. For example, when a house is struck by lightening, absent the use of various ground prongs, the electrical energy of the lightening could be routed through all the ungrounded electrical circuits including appliances connected to these circuits. This electrical energy would destroy many of these ungrounded appliances. One solution to this problem is to provide a ground path to allow this electricity to be dissipated into the earth or ground.

Yet another reason behind the three-prong design, when mounted with the ground socket uppermost, may be to lessen the likelihood that a circuit could be formed directly across the hot and neutral prongs. Namely, the ground prong can act as a barrier or guard that prevents a piece of conductive material (for example, a cookie sheet) from slipping into the space between the power plug and power receptacle and forming a short circuit between the hot and neutral prongs. Were such a short circuit to occur, the high current can vaporize the metal prongs, which could cause a fire or other damage.

Power receptacles are typically set in a dual- or duplex-outlet configuration whereby two power receptacles are stacked one on top of one another. In most of these duplex-outlet power-receptacle configurations, the power-receptacle sockets are arranged such that the hot, neutral, and ground sockets have the same orientation, and wherein each feature of the upper receptacle is approximately 39 millimeters above the corresponding feature of the lower receptacle. Further, typically, the screw connectors for the neutral and ground wires are all on one side of the outlet device, and the screw connectors for the hot wire(s) are on the opposite side of the device. Further still, many companies and electrical inspectors recommend that conventional duplex outlets be installed having the hot and neutral slots, which are set parallel to each other, oriented vertically, with the hot slot on the left and the neutral slot on the right, and the ground socket of each receptacle set above these parallel slots, in what is called a ground-up orientation or configuration. Some electricians and homeowners prefer to have the ground socket below the hot and neutral sockets (with the hot slots on the right and the neutral slots on the left), in what is called a ground-down orientation or configuration.

One problem that occurs with such conventional residential plugs and sockets is that sliding and compressive forces must be overcome when inserting and withdrawing such plugs from their sockets. As current requirements increase (particularly for 50 amperes and above), it is quite difficult for a person of ordinary strength to insert or withdraw the plug, or, on the other hand, the spring force becomes weakened after repeated uses and the contacts are electrically unreliable and the resulting high-resistance connections can heat up and become a fire hazard.

Some conventional plug-outlet designs have twist-lock or screw-on covers that substantially prevent pulling force from withdrawing the plug. These are undesirable for vehicle connections, since if the vehicle moves, the plug and/or outlet are destroyed rather than simply unplugging as the boat or RV backs away from the docking station.

What is needed is an improved plug-outlet design that overcomes shortcomings of conventional outlet designs, while providing improved usability and/or safety characteristics.

BRIEF SUMMARY OF THE INVENTION

The present invention provides a method and apparatus to address the problems of simultaneously providing low or zero insertion force, while providing high compressive force and good wiping action as the electrical contact is being made and used. Further, some embodiments provide the high contact force without actually locking the plug to the outlet, in order that if the plug or power cord is pulled on, it will eventually come unplugged before the plug, cord, or outlet is damaged. One advantage of some embodiments of the present invention is that it allows for the utilization of the conventional three-prong power plug.

In some embodiments, the present invention provides an independently tightening collet surrounding each socket for each of a plurality of corresponding prongs, wherein the collet is loosened for normal (low-insertion-force) insertion and withdrawal of the plug from the outlet. Once the plug is inserted, the collet is tightened, providing a high-contact force to lower the contact resistance and to help keep the plug from coming unplugged. In some embodiments, the plug is not "locked", in that a tension force (e.g., from the vehicle pulling away, or from a person pulling on the cord hard enough) pulling on the plug will overcome the contact force at a point before the plug or outlet is damaged, and the plug is allowed to come unplugged. In some embodiments, engaging the collet will also provide a wiping or sliding motion between the prong and socket for each connection, thus wiping at least some dirt or corrosion away and providing a lower-resistance better electrical contact.

In various embodiments, the "outlet" portion is on a surface of the vehicle (e.g., on the hull of a boat, or back wall of a recreational vehicle (RV) or mobile home, or otherwise on a surface of the vehicle) and the power cord from the docking station is run out to the vehicle and plugged into the vehicle. In other embodiments, the "outlet" portion is on a surface of the docking station, and the power cord is run from the vehicle and plugged into the docking station. In some embodiments, an outlet of the present invention is provided on both the vehicle and the docking station, and the power wiring cord has a plug according to the present invention on both ends of the cord.

In some embodiments, the outlet of the present invention includes a plurality (e.g., three, in some embodiments) of recessed fixed prongs (male connectors), and the plug includes a corresponding number of sockets each having a tightenable, independent collet that can be activated to tighten onto its respective prong upon manual activation by the user (e.g., by pushing or pulling on one or more activation handles). In some embodiments, each collet has its own spring that imparts a predetermined amount of contact force, resulting in a reliable, repeatable force being applied on each electrical contact. In some embodiments, each socket has a plurality of fingers (e.g., three fingers arranged 120 degrees from each other in a circle around the prong) that, when they are squeezed by the collet, impart a slight wiping action against the sides of the prong. In other embodiments, no wiping action is applied, and the fingers simply tighten on the prong. By placing the prongs in a recessed fixed configuration on the outlet portion of the connection, there are no moving parts on the outlet (which is harder and more costly to repair or replace), and the moving parts in the power cord can be replaced more inexpensively.

In other embodiments, the fixed prongs are on the cord's plug (as with conventional household cords and plugs), and the outlet has the socket portions of the connection and the collets that tighten the sockets on their respective prongs.

In still other embodiments, the outlet has fixed socket portions of the connection (with no collets), and the cord's plug includes expanding prongs that tighten by expanding on the insides of their respective fixed sockets.

DETAILED DESCRIPTION OF THE INVENTION

Figure 1:
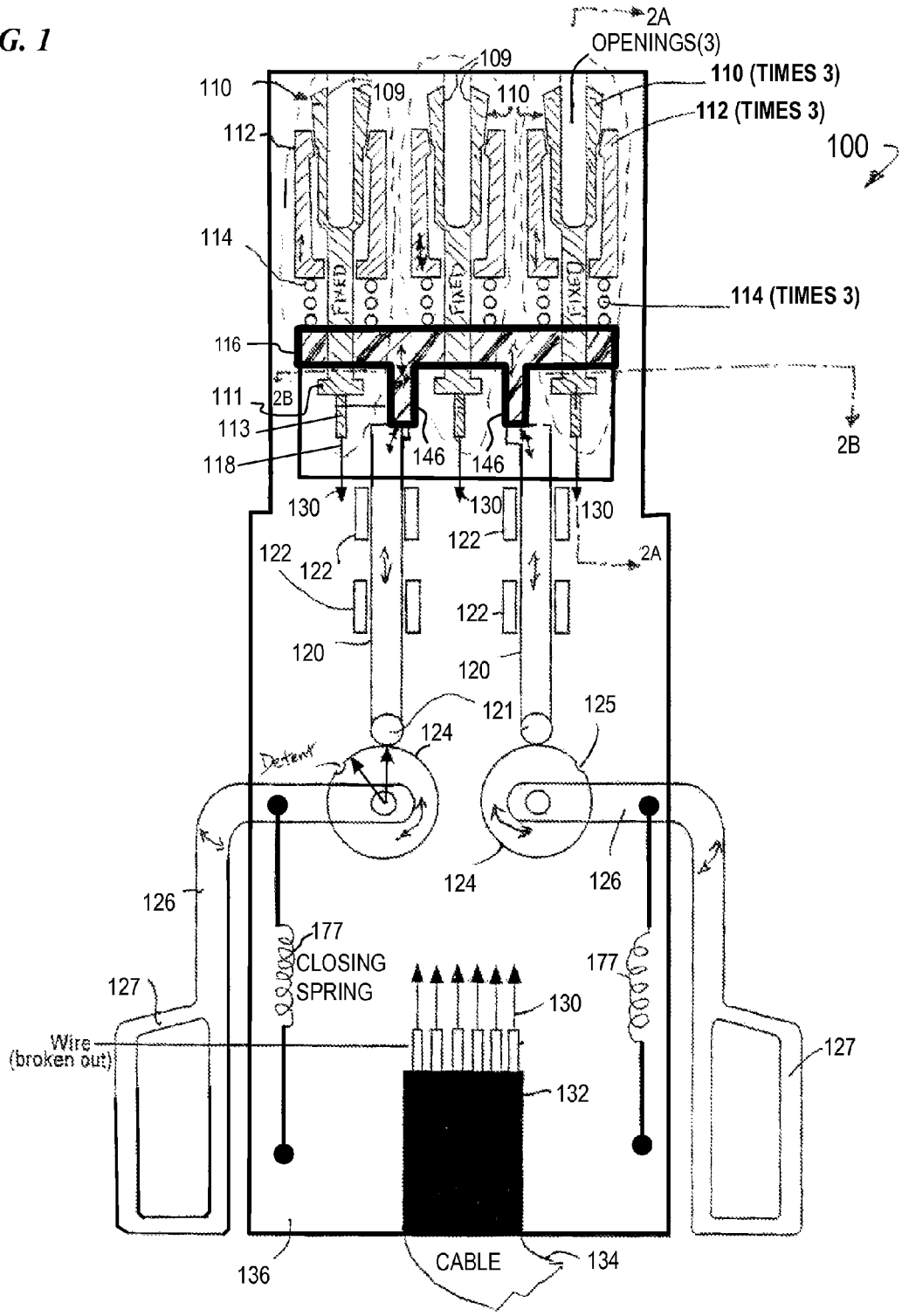
FIG. 1 is a cross-section plan view of an electrical plug 100.

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component that appears in multiple Figures. Signals and connections may be referred to by the same reference number or label, and the actual meaning will be clear from its use in the context of the description.

For the purpose of this description, the phrase "power receptacle" is synonymous with the phrases electrical-power receptacle, main power receptacle, plug-in, outlet, power receptacle, female power prong, or any other phrase denoting an apparatus designed to provide access to electrical power using a plurality of (e.g., three) slots or sockets.

Below are alternative embodiments for certain features of the connector. In some embodiments, the split contact extends through the stationary block with a threaded end. At the top of the threaded end the contact has a shoulder area that is received by a complimentary shoulder area within the stationary block. The bottom of the threaded end receives a nut, which locks the contact into the stationary block. This threaded end is also hollow to receive wire that has had its insulation stripped.

A description of contact and wire installation is as follows: Prior to installing the contact, the wire is stripped, the nut is placed on the wire and then the wire is inserted through the stationary block and the split contact compressors. The wire is then inserted into the hollow lower shaft of the contact and it is either crimped or soldered in. The wire and the contact are then pulled down through the above-mentioned parts until the contact shoulder is resting on the mating shoulder of the stationary block. The nut is then threaded onto the threaded end of the contact and tightened, pulling the contact into firm communication with the stationary block and securing the contact in place.

Another preferred element are cams which are rotated with the lock/unlock handles. As the handles are rotated forward linked to one-another by gears between the handle assemblies, a captured ball bearing (or roller) attached to the end of the push rods rides on the cams. As the cams rotate just beyond their high points, the ball bearing (roller)/push rod assemblies drop into the detents, which positively lock the handles into locked position. When in locked position, the push rods are fully pushed up and the split contact compressors have fully compressed and clamped the split contact onto the mating male pin that is being supplied with power.

Some embodiments combine the flatted cams with the other type of push-rod ends as presented earlier. Some embodiments use a split-contact compressor-retraction device shown.

An electrical connector for use particularly in high-power applications where the connector is large and frequently must be installed and removed. An electrical connector that also is installed and removed from its mating connector with little or no friction (little or no force applied to each prong by its respective socket). The connector includes an outer housing and at least one electrical socket contact, typically several. The socket contact has a split configuration that is compressed onto the mating pin from the device that is being powered. Mechanical means are provided for handling the connector, actuating an electrical socket compression device and as a result providing positive individual electrical-pin contact.

The present invention relates to a power connector that may be preferably used for, but is not restricted to, supplying power to mobile devices such as boats, ships and airplanes when they are in port being serviced or temporarily docked.

There are several well-known problems with existing power connectors that should be fixed, as they represent nuisance, functionality, damage and safety issues. A list of problems with existing power connectors is as follows:

Most have multiple large socket contacts that provide a friction fit to mate with the male pin to which power is being provided. This makes it very difficult to install and remove them from the mating connector.

Given that a friction fit is provided, each time the connector is installed and removed, a small amount of material is eroded from the pin and socket. As wear progresses the pin-to-socket contact may become quite loose, representing increased electrical resistance. Depending on the pin arrangement within the connector, the sockets may be differentially worn such the pin/socket electrical resistance from one contact to the next will be different. As the electrical resistance increases, heat builds up and oxidizes the contact surface. This in turn causes an increased rate of contact erosion and increased heat, which can cause internal damage to both the power connector and wires as well as the connector receiving power and its wires. This ultimately may result in the requirement for expensive repairs; power-failure and potential short-circuit conditions representing a human safety problem.

Large power connectors typically do not have a defined location for the user to handle them and provide an appropriate point of leverage to apply force for the installation and removal of the connector. Given this, the user many times will inappropriately use the insulated cable that contains the electrically conductive wires to remove the connector. This may eventually stress the wires, loosen the cable within the connector and stress and loosen the wires at the electrical contact internal to the connector. The user will also wiggle the connector from side to side to break friction with jerks, which will result in damaging the electrical sockets, expanding and deforming their internal surface.

Given the above-described problems, there remains a need for a power connector that provides means to deal with and correct these problems.

DETAILED DESCRIPTION

Description of Operation

FIG. 1: Starting from the bottom of the cross-sectional plan view of FIG. 1 (which illustrates one embodiment of the present invention), one can see the insulated electrical cable providing multiple insulated wire conductors which (shown with arrows) connect with the split electrical socket contacts above. At the sides are shown actuation handles that are connected to a rotational cam, which, when the handles are rotated forward, causes the cam to rotate. As the cam rotates, a cam follower (a captured ball or roller bearing) which is attached to the base of a cylindrical push rod rolls on the cam surface and lifts the push rod as the cam height increases. At the peak of cam height and full travel of the handles, the cam follower drops into a detent, which tends to lock the handles and push rods into place.

As the push rods are pushed up they are guided by bushings and then by a stationary block above the bushings. The stationary block also locks the electrical contacts into place, is conformed to, and mates with a push plate above. The push plate has bushed reception sites into which the push rods fit. As the push rods are lifted the push plate is also lifted. Riding on top of the push plate are compression-force-equalizing springs. Above and riding on the springs are tapered bushings which, as they ride up on the mating tapered surface of the split electrical contact socket, compress the socket, closing the gap between the socket's split segments. As socket compression takes place the socket is brought into positive contact with the pin it is mating to. The springs below the tapered bushing tend to equalize the compression force from socket to socket and ensure that when one socket/pin contact is made the force is directed to the others that are then individually made.

Once the sockets are all compressed this tends to lock the power connector onto its mating connector. However the outer shell configuration of the connector must still be designed to mate correctly with its mating connector so that the load of the cable and connector weights is carried by the connector's outer shell.

When it is desired to remove the power connector from the device it is servicing, the user pulls the handles back to their initial position, which drops the push rod assembly and unlocks the compressed sockets from the mating pins. The user then uses the leverage of the handles to apply force to remove the connector.

Problems Solved:

This connector does not employ a push-on-type friction fit, so it will be "very" much easier for the user to install and remove, as the user will only be dealing with the weight of the connector and cable, not having to overcome friction forces.

Since these contacts do not rely on a friction fit, they are not eroded, sprung open, and/or damaged as the connector is installed and removed. In addition, since each electrical socket contact conforms individually to the mating pin (prong), a positive electrical connection between the pin and socket is ensured. This prevents excessive heating due to electrical resistance build-up because of mechanical-fit issues, and resulting increase in material oxidation and erosion. As a result, many of the historical power-connector problems typically resulting in power conduction failure, connector internal damage and danger of short circuit due to burnt wires are avoided.

Since this connector has handles which define the location at which the user will apply installation and removal force, it is much less likely that the user will inappropriately pull on the conductive cable or wiggle the connector back and forth to break friction. This will result in much less tendency for wire fatigue and breakage as well as increased wear on other connector parts.

FIG. 1 is a cross-section plan view of an electrical plug 100. In some embodiments, plug 100 includes a plurality of sockets 110 (e.g., 3, 4, 6, or other suitable numbers of sockets), each socket configured to be compressed around a corresponding pin in the receptacle (e.g., outlet 301 of FIG. 3A), each socket having a plurality of fingers 109 having tapered outer portions configured to be pushed inward by collet 112 when collet 112 is (independently of the other collets) pushed upward by spring 114 driven by push plate 116, which is driven by push rods 120, which are guided by bushings 122. Stationary insulator block 118 holds the shaft ends 111 of sockets 110. In some embodiments, push rods 120 have entrapped ball bearing 121, which drop into detent 125 of cam 124 when rotated by handles 127 on the ends of arms 126. A plurality of wires 130 extend from cable holder 132 to respective ones of the shaft ends 113 of sockets 110. Cable 134 extends to a source of power that is to be supplied to the vehicle (e.g., a boat, RV, or other vehicle) when plug 100 is inserted into a corresponding receptacle on the vehicle. In some embodiments, the handles 127 are extended outward (such that detent 125 allows push rods 120 to extend downward) for inserting or withdrawing the plug 100 from the receptacle, and handles are push inward to the position shown, with the cams 124 pushing the push rods 120 upward to push collets 112 with individual springs 114 to tighten the sockets at even and independent pressures around their respective prongs in the receptacle. Plug body 136 is made of a suitable insulator, such as plastic material. In some embodiments, the size of plug 100 is as small as an ordinary household electrical cord plug, while in other embodiments, the size is as large as needed for high-current (e.g., 100s of amps or more) applications needed by a larger vehicle such as an ocean-going ship. The even clamping forces provided by individual springs and collets means that even predetermined clamping forces are applied to each individual pin of the receptacle, resulting in a high-quality electrical connection. In the embodiment shown, there are three columns of sockets 110. In other embodiments, these sockets 110 can be arranged in patterns other than straight rows and columns.

Referring further to FIG. 1, in some embodiments, the handles 127 are spring loaded (pulled downwards by springs 177), such that the operator must force the handles 127 up into the "release" position in order to plug the plug 100 into its receptacle (e.g., receptacle 501 of FIG. 5A), and when the handles 127 are released, the spring loading of springs 177 automatically pulls down and closes the handles 127 to the in and down, locked, and clamping configuration. This helps prevent an operator from accidentally not forcing the handles into the engaged position, since when the operator releases the handles, they automatically move to the clamping position by springs 177. Also, by pushing on the handles 127 to insert the plug 100 into its receptacle, the operator automatically pushes the handles into the non-compression configuration for the sockets; then holding the handles to keep the plug inserted and in place, the handles are pushed or released inward, clamping the plug in place on its prongs. In some embodiments, such a spring-loaded handle-engaging embodiment is used with other systems described herein.

Referring again to FIG. 1, reference number 110 refers to split electrical contact sockets (to accept power pin). Reference number 112 refers to tapered bushings (to compress split electrical socket). Reference number 114 refers to springs (for equalized socket compression). Reference number 116 refers to an insulating push plate (moves ⅛ inch with actuation). Reference number 111 refers to an electrical contact retention tab (holds contact in block). Reference number 113 refers to wire. Reference number 118 refers to an insulating block. Reference number 122 refers to bushing (guides push rod). Reference number 120 refers to a push rod. Reference number 121 refers to a cam follower (ball bearing). Reference number reference 125 refers to a cam detent. Reference number 126 refers to an actuation handle. Reference number 130 refers to wire (broken out). Reference number 134 refers to a power cable. Reference number 146 refers to webbing. Reference number 177 refers to a closing spring.

Figure 2A:
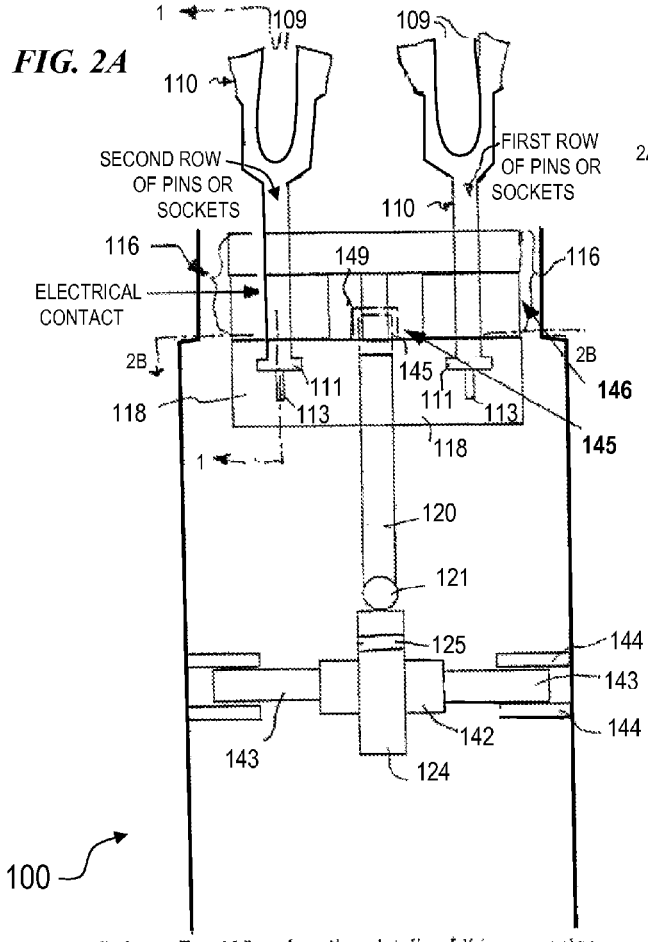
FIG. 2A is a cross-section side view (at right angles to the view of FIG. 1) of electrical socketed plug 100.

FIG. 2A shows a partial cross-section view from the side (90 degrees to FIG. 1) of electrical socketed plug 100. The cam 124 and handle attachment sites 142, and axle 143 and bushings 144 that support and allow cam rotation are seen in the lower left. In the embodiment shown, there are two rows of sockets 110. The cam follower 121, push rod 120, stationary block 118, push plate 116 and the bottom portion of the electrical contact 111 and wire attachment 113 are presented. In the connector presented there are a total of six (6) electrical contacts, three (3) in each of two (2) rows.

Referring again to FIG. 2A, which is a partial side view of the frictionless locking power connector, reference number 118 refers to a stationary block. With further regard to FIG. 2A, refer to front view for other details of this connector because the clamping portion of split electrical contact, handle, and feeder wires are not shown. Reference number 111 refers to the electrical contact (only bottom shown). Reference number 142 refers to the handle attach point. Reference number 143 refers to the axle. Reference number 144 refers to the axle bushing. Reference number 145 refers to the push-rod reception site.

Figure 2B:
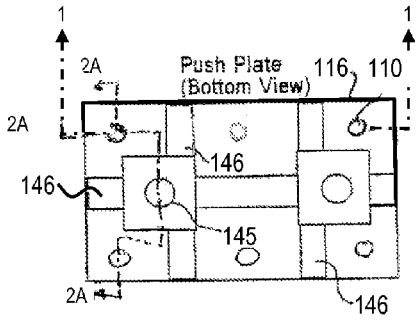
FIG. 2B is a cross-section bottom view (at right angles to the view of FIG. 1) of electrical plug push plate 116.

FIG. 2B is a bottom cross-section bottom view (at right angles to the view of FIG. 1) of electrical plug push plate 116. FIG. 2B a bottom view of the push block 116 is shown indicating the location of the push-rod reception site 145 (having internal bushing 149) and webbing 146 cast into the push block for increased strength.

Referring again to FIG. 2B, which is a bottom view of push plate 116, reference number 146 refers to webbing reinforcement.

Figure 2D:
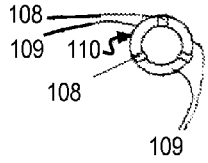
FIG. 2D is a cross-section end view of electrical plug compressible socket 110.
Figure 2C:
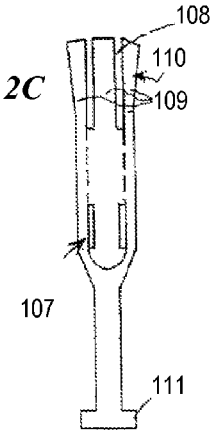
FIG. 2C is a cross-section side view of electrical plug compressible socket 110.

In FIG. 2C is a representation of the split electrical socket contact showing the split segments 109 in the socket 110, the tapered outer surface and in FIG. 2D is an end view of the circumference of the socket showing the split segments 109.

In some embodiments, an electrically conductive radial compressible sleeve 107 is added to provide a secondary electrical-current path to ensure and improve current conduction as shown in FIG. 2C. Initially this sleeve is bowed inward toward the center of the electrical socket. As the mating pin is inserted and makes contact, the sleeve is flattened out and maintains a spring force on the surface of the mating pin. This arrangement is typical of some power connectors, except that in this case the length of the sleeve is not the same as the length of the socket. The length of the sleeve is much reduced so as to provide much less frictional force upon pin insertion. In this case both the compression of the split socket 110 and the compression of the conductive sleeve 107 provide electrical-current conduction.

FIG. 2C is a cross-section side view of electrical plug compressible socket 110. In some embodiments, socket 110 includes a plurality of fingers 109 (e.g., in some embodiments, three fingers), separated by slots 108. Some embodiments include a radial compressive sleeve 107. In some embodiments, the shape of each finger 109 is slightly S-shaped, such that when the collet is pushed upward on the finger 109, both an inward compression and an upward (or downward) sliding force is applied, thus cleaning the contact area.

FIG. 2D is a cross-section end view of electrical plug compressible socket 110 showing fingers 109 and slots 108.

Figure 2E:
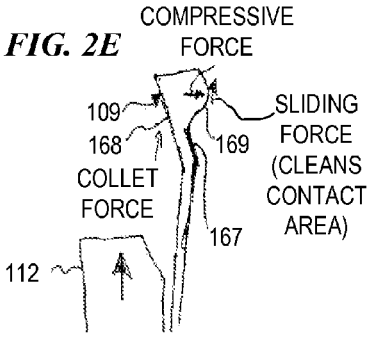
FIG. 2E is a cross-section close-up view of electrical plug socket finger 109 showing the wiping action achieved when the collet 112 slides onto finger 109 tightening it on the prong.

FIG. 2E is a cross-section close-up view of electrical plug socket finger 109 showing the wiping action achieved when the collet 112 slides onto finger 109 tightening it on the prong. The middle portion 167 of finger 109 (i.e., the lowest portion of ramp 168) is initially bent outward (to the left). As collet 112 raises, it presses against ramp 168 which straightens the lower portion 167 of the finger and causes contact surface 169 to slide both inward (rightward in FIG. 2E) and vertically upward against the inserted prong (since the straightened finger 109 reaches further upward than the initially bent finger 109), wiping and cleaning the contact area of the prong and contact surface 169.

Figure 3A:
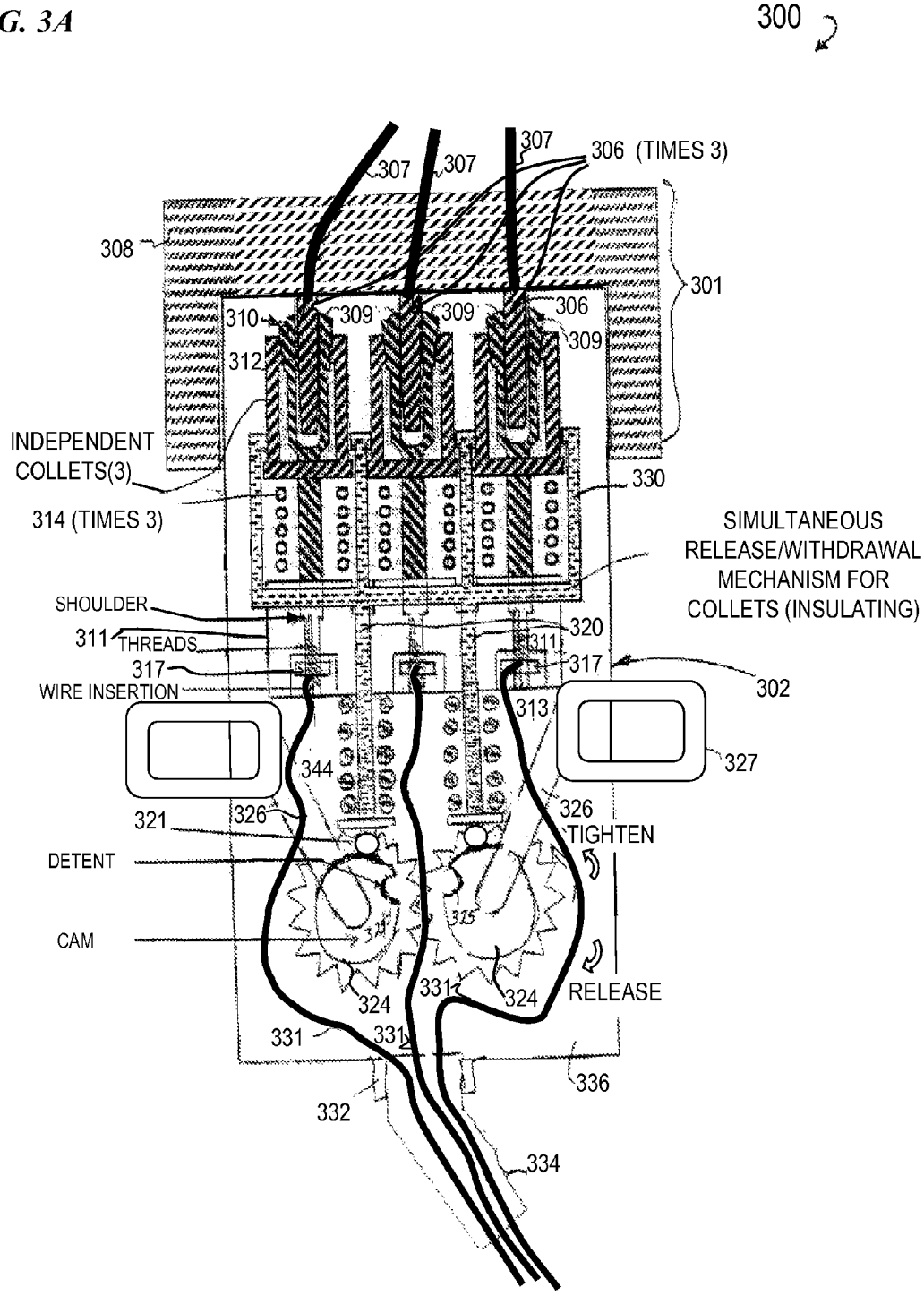
FIG. 3A is a cross-section plan view of electrical connection system 300 having a socketed plug 302 with collet releaser 330, where the plug 302 is inserted and clamped in pronged receptacle 301.

FIG. 3A is a cross-section plan view of electrical connection system 300 having a socketed plug 302 with collet releaser 330 (alternatively, collet withdrawer 330), where the plug 302 is inserted and clamped in pronged receptacle 301. This embodiment is similar to FIG. 1, except with the addition of collet releaser 330, which acts to pull collets 312 down when the handles are released, relieving the compressive force on pins or prongs 306. Receptacle 301 includes an insulator body 308 holding three pins 306, each connected to a respective wire 307 leading to interior connections in the vehicle. Plug 302 includes a plurality of sockets 310 (e.g., 3, 4, 6, or other suitable numbers of sockets), each socket 310 configured to be compressed around a corresponding pin 306 in the receptacle 301, each socket 310 having a plurality of fingers 309 having tapered outer portions configured to be pushed inward by collet 312 when collet 312 is (independently of the other collets) allowed to be pushed upward by smaller spring 314 when released by collet withdrawer 330, which is driven by push/pull rods 320, which are biased downward by larger springs 344. Stationary insulator block (not shown) holds the threaded shaft ends 311 of sockets 310, screwed into nuts 317. In some embodiments, push rods 320 have entrapped ball bearing 321, which drop into detent 325 of cam 324 when the cam is rotated by handles 327 on the ends of arms 326. A plurality of wires 331 extend from cable holder 332 to respective ones of the shaft ends 313 of sockets 310. Cable (electrical power cord) 334 extends to a source of power that is to be supplied to the vehicle (e.g., a boat, RV, or other vehicle) when plug 302 is inserted into a corresponding receptacle 301 on the vehicle. In some embodiments, the handles 327 are extended outward and backward (down in the FIG. 3A, such that detent 325 allows push rods 320 to extend downward) for inserting or withdrawing the plug 302 from the receptacle 301, and handles are pushed forward, upward and inward to the position shown, with the cams 324 pushing the push rods 320 upward to release collets 312 with individual springs 314 to tighten on the sockets 310 at even and independent pressures around their respective prongs 306 in the receptacle 301. Pushing the handles in the direction of the plug insertion allows the force used to tighten the handles 327 to also force the plug into a tighter embrace to receptacle 301, while pulling on the handles 327 both loosens the clamping on the pins and withdraws the plug 302 from receptacle 301. Plug body 336 is made of a suitable insulator, such as plastic material. In some embodiments, the size of plug 302 is as small as an ordinary household electrical cord plug, while in other embodiments, the size is as large as needed for high-current (e.g., hundreds of amps or more) applications needed by a larger vehicle such as an ocean-going ship. The even clamping forces provided by individual springs and collets means that even predetermined clamping forces are applied to each individual pin of the receptacle, resulting in a high-quality electrical connection. In the embodiment shown, there are three columns of sockets 310. In other embodiments, these sockets 310 can be arranged in patterns other than straight rows and columns.

Referring again to FIG. 3A, reference number 321 refers to a captured ball bearing or roller. Reference number 344 refers to big springs to withdraw collets.

Figure 3B:
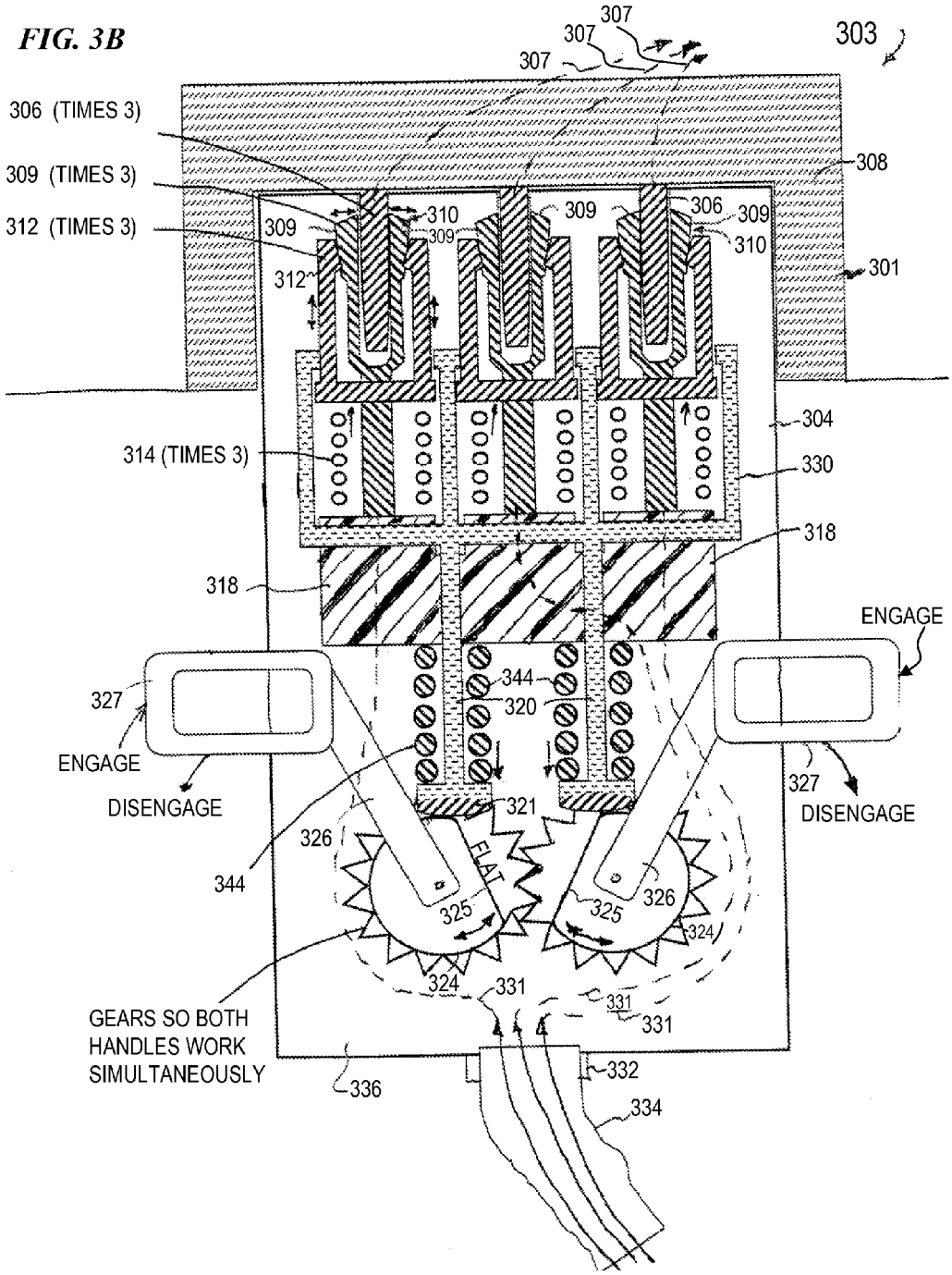
FIG. 3B is a cross-section plan view of electrical connection system 303 having a socketed plug 304 with collet releaser 330, where the plug 304 is inserted and clamped in receptacle 301.

FIG. 3B is a cross-section plan view of electrical connection system 303 having a socketed plug 304 with collet releaser 330, where the plug 304 is inserted and clamped in receptacle 301. This is similar to system 300 of FIG. 3A, except that the detents 325 are flat portions of cams 324. When the bearing surfaces 321 are on flats 325, the springs 344 overpower springs 314 and collet holder 330 moves downward to force collets 312 down, releasing the pressure of sockets 310 on pins 306.

Figure 3C:
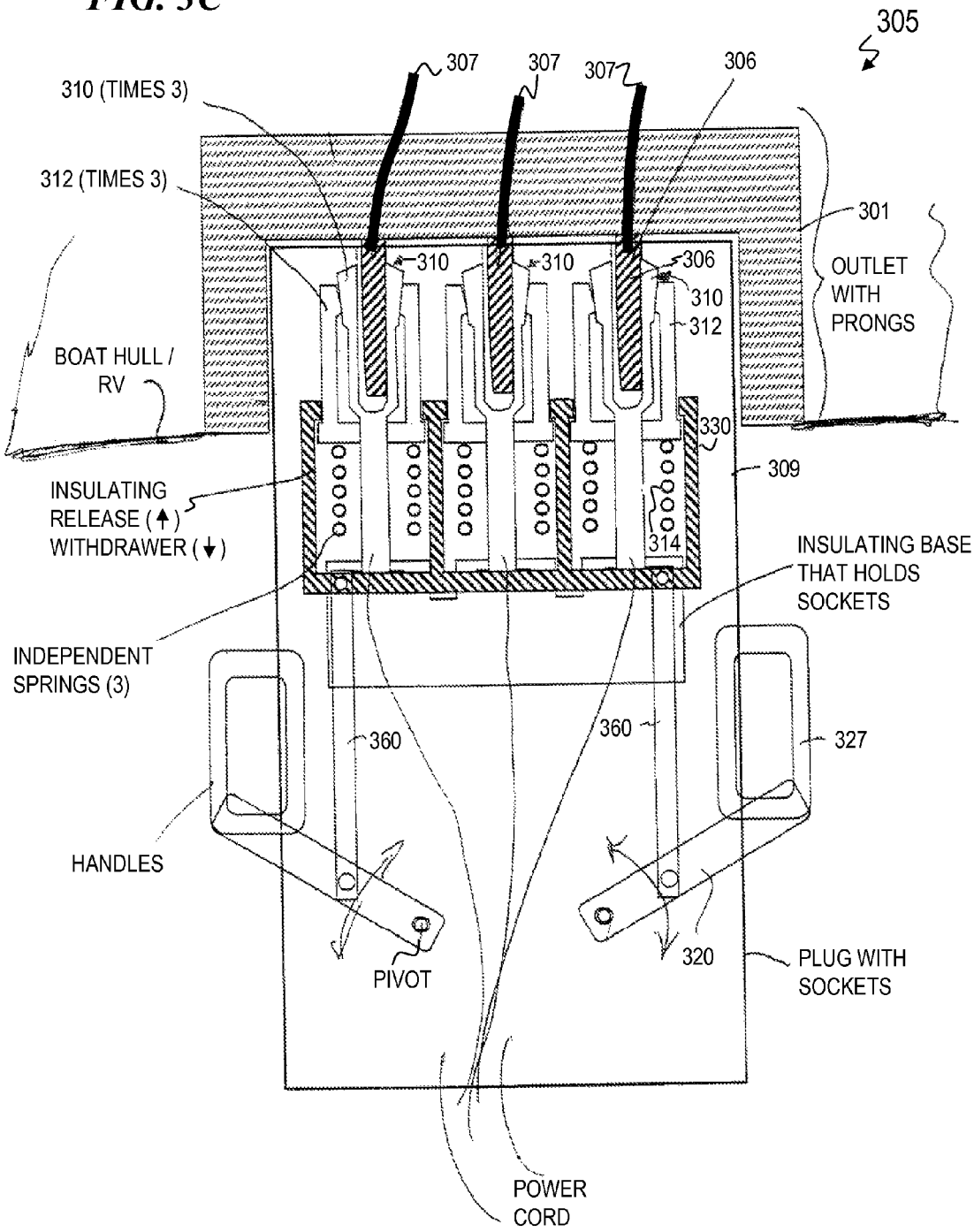
FIG. 3C is a cross-section plan view of electrical connection system 305 having a socketed plug 309 with collet releaser 330, where the plug 309 is inserted and clamped in receptacle 301.

FIG. 3C is a cross-section plan view of electrical connection system 305 having a socketed plug 309 with collet releaser 330, where the plug 309 is inserted and clamped in receptacle 301. System 305 is similar to system 303 of FIG. 3B, except that a direct link 360 moves collet holder 330 upward to allow springs 314 to force collets 312 to tighten sockets 310 to connect, or downward to force collets 312 down, releasing the pressure of sockets 310 on pins 306 to unplug.

Figure 4:
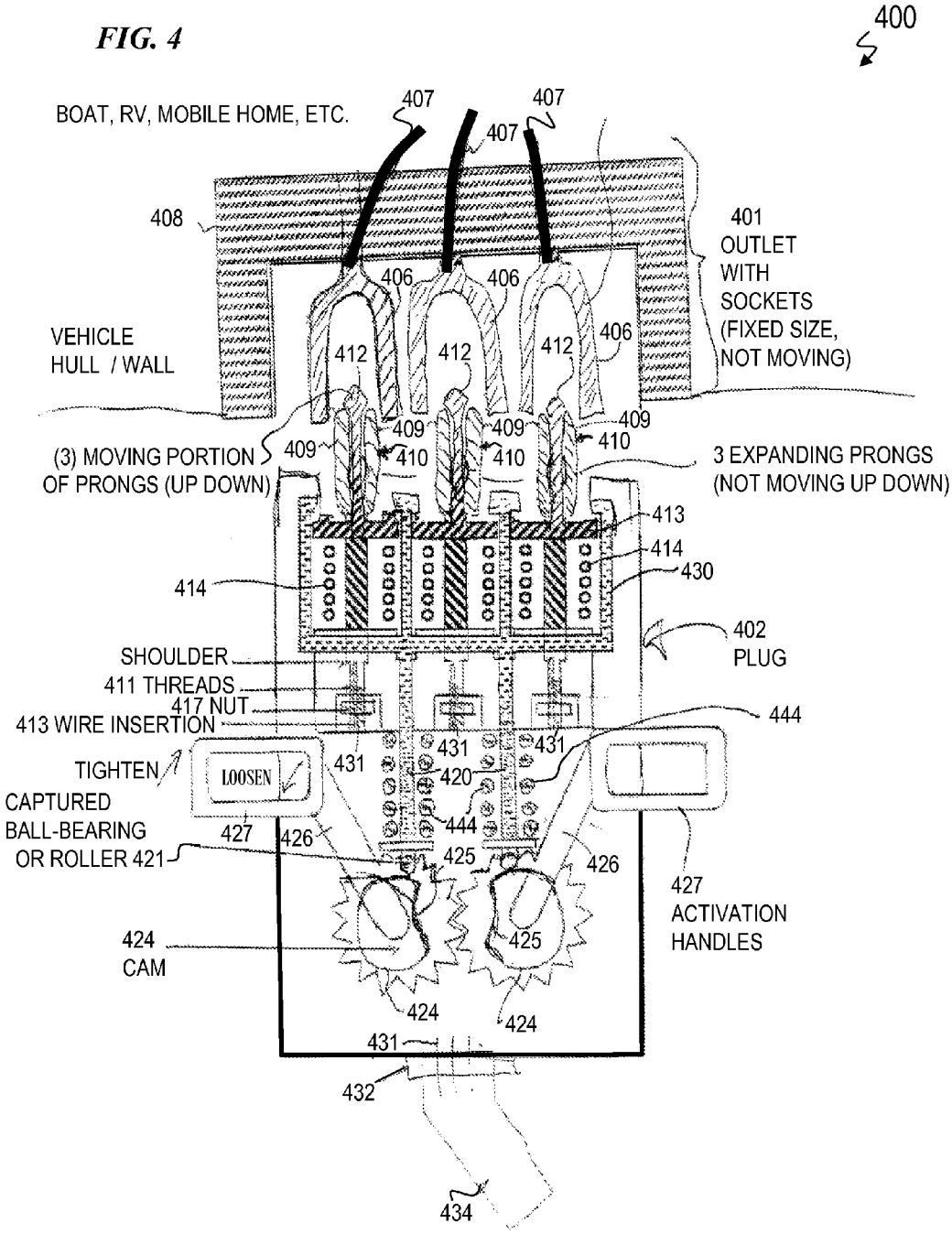
FIG. 4 is a cross-section plan view of electrical connection system 400 having a pronged plug 402 with collet releaser 430, where the plug 402 is inserted and clamped in socketed receptacle 401.

FIG. 4 is a cross-section plan view of electrical connection system 400 having a pronged plug 402 with prong-base releaser 430, where the plug 402 is inserted and clamped in socketed receptacle 401. This system 400 is conceptually the opposite of system 303 of FIG. 3B, in that the plug 402 has expanding pins 410 (instead of contracting sockets 310), and receptacle 401 has fixed sockets 406 (instead of fixed pins 306). Receptacle 401 includes an insulator body 408 holding a plurality of fixed sockets 406 (e.g., three, four, six, or other suitable numbers of sockets 406), each connected to a respective wire 407 leading to interior connections in the vehicle. Plug 402 includes a plurality of expanding pins 410 (e.g., three, four, six, or other suitable numbers of sockets), each expanding pin 410 configured to be expanded outward a corresponding socket 406 in the receptacle 401, each expanding pin 410 having a plurality of fingers 409 having tapered outer portions configured to be pushed outward by tapered shaft 412 when shaft base 413 is (independently of the other shaft bases) allowed to be pushed upward by smaller spring 414 when released by shaft withdrawer 430, which is driven by push/pull rods 420, which are biased downward by larger springs 444. Stationary insulator block (not shown) holds the threaded shaft ends 411 of expanding pins 410, screwed into nuts 417. In some embodiments, push rods 420 have entrapped ball bearing 421, which drop into detent 425 of cam 424 when the cam is rotated by handles 427 on the ends of arms 426. A plurality of wires 431 extend from cable holder 432 to respective ones of the wire receiver on shaft ends 413 of expanding pins 410. Cable (electrical power cord) 434 extends to a source (or destination, in the case where the vehicle is supplying power to an electrical load off the vehicle, such as a trailer or the like) of power (not shown) that is to be supplied to the vehicle (e.g., a boat, RV, or other vehicle) when plug 402 is inserted into a corresponding receptacle 401 on the vehicle.

Figure 5C:
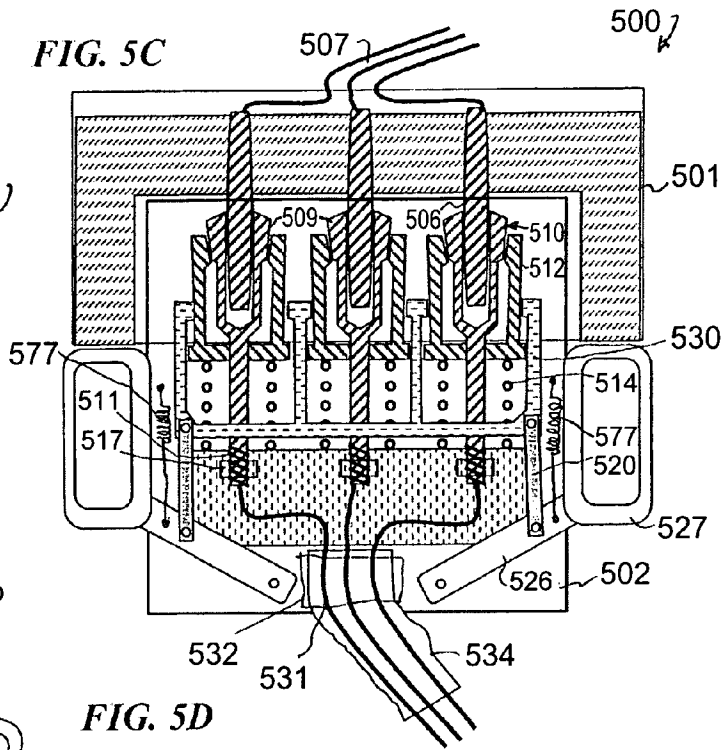
FIG. 5C is a cross-section plan view of electrical connection system 500 having a socketed electrical plug 502 with collet releaser 530, where the plug 502 is inserted and clamped in pronged receptacle 501
Figure 5D:
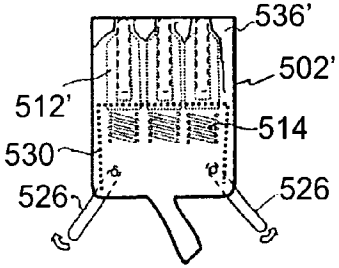
FIG. 5D is a plan view of a small version of socketed electrical plug 502'.
Figure 5A:
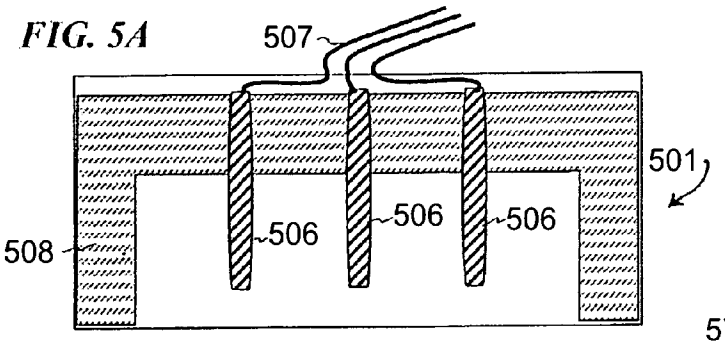
FIG. 5A is a cross-section plan view of pronged receptacle 501.

FIG. 5A is a cross-section plan view of pronged receptacle 501. This embodiment receptacle 501 is similar to receptacle 301 in FIG. 3A: collet releaser 530 acts to pull collets 512 down when the handles are released, relieving the compressive force on pins or prongs 506. Receptacle 501 includes an insulator body 508 holding three pins 506, each connected to a respective wire 507 leading to interior connections in the vehicle.

Figure 5B:
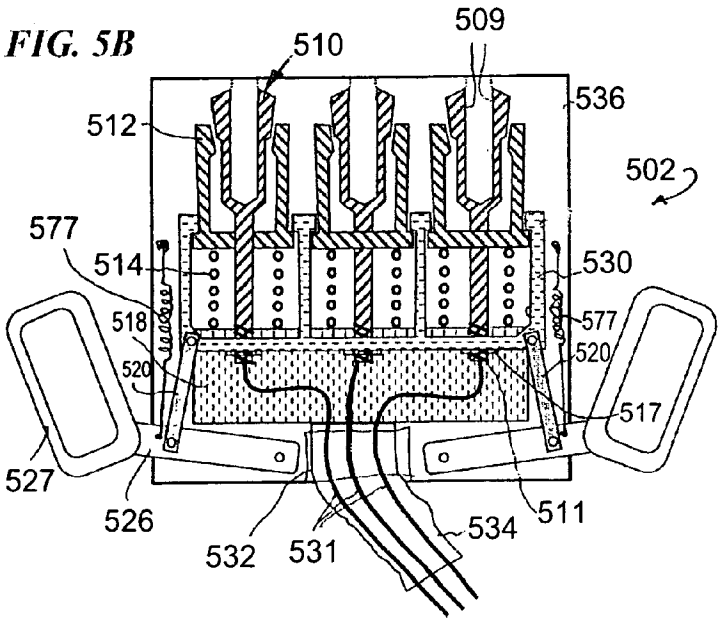
FIG. 5B is a cross-section plan view of socketed electrical plug 502 with collet releaser 530.

FIG. 5B is a cross-section plan view of socketed electrical plug 502 with collet releaser 530. In some embodiments, plug 502 includes a plurality of sockets 510 (e.g., 3, 4, 6, or other suitable numbers of sockets), each socket 510 configured to be compressed around a corresponding pin 506 in the receptacle 501, each socket 510 having a plurality of fingers 509 having tapered outer portions configured to be pushed inward by collet 512 when collet 512 is (independently of the other collets) allowed to be pushed upward by spring 514 when released by collet withdrawer 530, which is driven by push/pull rods 520. Stationary insulator block 518 holds the threaded shaft ends 511 of sockets 510, screwed into nuts 517. In some embodiments, push/pull rods 520 are moved up and down by rotating handles 527 on the ends of handle arms or shafts 526. A plurality of wires 531 extend from cable holder 532 to respective ones of the shaft ends 511 of sockets 510. Cable 534 extends to a source of power that is to be supplied to the vehicle (e.g., a boat, RV, or other vehicle) when plug 502 is inserted into a corresponding receptacle 501 on the vehicle. In some embodiments, the handles 527 are extended outward and backward (down in the FIG. 5A, such that push rods 520 pull downward) for inserting or withdrawing the plug 502 from the receptacle 501, and handles are pushed forward, upward and inward to the position shown, pushing the push rods 520 upward to release collets 512 with individual springs 514 to tighten on the sockets 510 at even and independent pressures around their respective prongs 506 in the receptacle 501. Pushing the handles in the direction of the plug insertion allows the force used to tighten the handles 527 to also force the plug into a tighter embrace to receptacle 501, while pulling on the handles 527 both loosens the clamping on the pins and withdraws the plug 502 from receptacle 501. Plug body 536 is made of a suitable insulator, such as plastic material. In some embodiments, the size of plug 502 is as small as an ordinary household electrical cord plug, while in other embodiments, the size is as large as needed for high-current (e.g., hundreds of amps or more) applications needed by a larger vehicle such as an ocean-going ship. The even clamping forces provided by individual springs and collets means that even predetermined clamping forces are applied to each individual pin of the receptacle, resulting in a high-quality electrical connection. In the embodiment shown, there are three columns of sockets 510. In other embodiments, these sockets 510 can be arranged in patterns other than straight rows and columns.

FIG. 5C is a cross-section plan view of electrical connection system 500 having a socketed electrical plug 502 with collet releaser 530, where the plug 502 is inserted and clamped in pronged receptacle 501. When handles 527 are pushed forward, they urge plug 502 toward socket 501 while also releasing the spring-loaded collets to clamp upon prongs 506 with a pre-determined force that is determined by the strength of the springs 514 and which is substantially independent of the force applied to the handles 527, thus ensuring the correct amount of force on the collets 510.

FIG. 5D is a plan view of a small version of a socketed electrical plug 502'. The body 536' of plug 502' forms the tightening taper into which collet-socket 512' is pushed by springs 514 when released by collet holder 530 connected to handles 526. Operation of plug 502' is substantially the same as for plug 501 of FIG. 5C, except that plug 502' is smaller and uses little thumb-operated handle shafts 526 rather than hand-operated handles 527 at the ends of the handle shafts 526 of FIG. 5C.

Figure 5F:
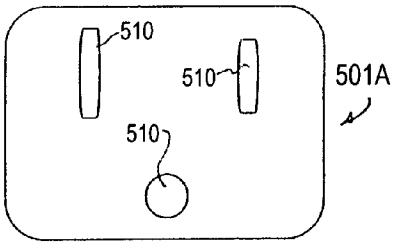
FIG. 5F is a front view of one embodiment pronged electrical receptacle 501A.
Figure 5G:
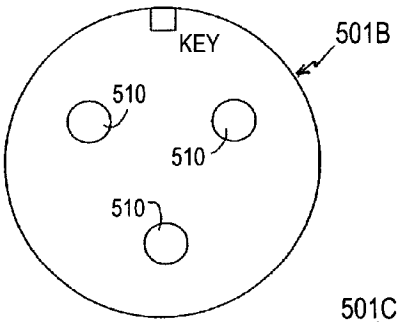
FIG. 5G is a front view of one embodiment pronged electrical receptacle 501B.
Figure 5H:
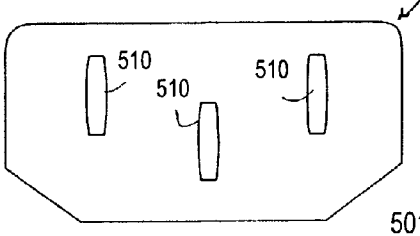
FIG. 5H is a front view of one embodiment pronged electrical receptacle 501C.
Figure 5I:
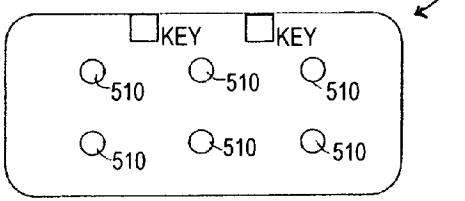
FIG. 5I is a front view of one embodiment pronged electrical receptacle 501D.
Figure 5E:
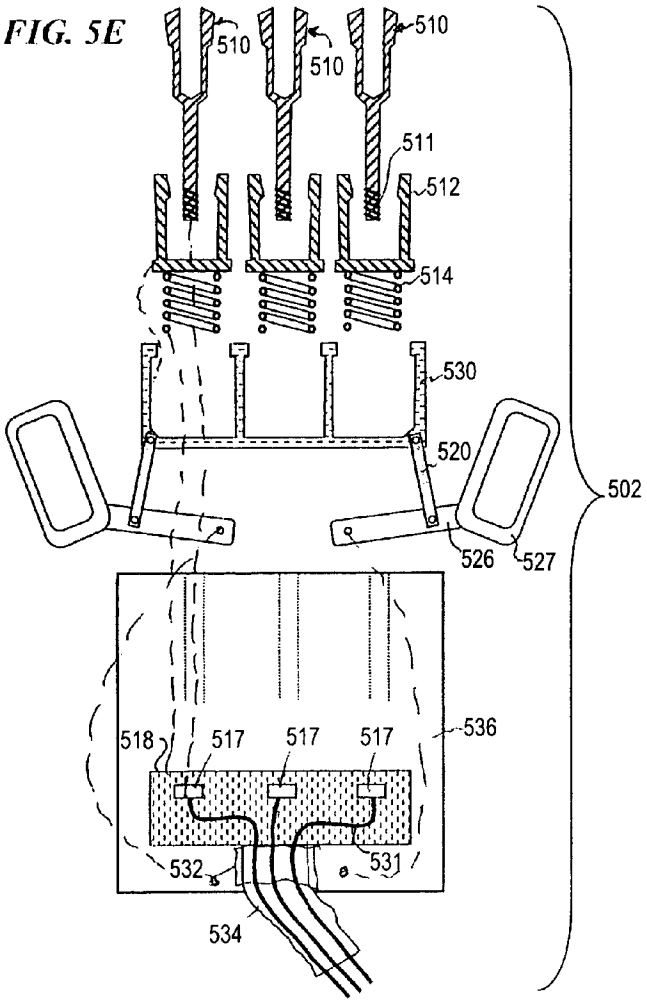
FIG. 5E is an exploded cross-section plan view of socketed electrical plug 502 with collet releaser 530.

FIG. 5E is an exploded cross-section plan view of socketed electrical plug 502 of FIG. 5B with collet releaser 530. The various parts are described above in the description of FIG. 5B.

FIG. 5F is a front view of one embodiment pronged electrical receptacle 501A. In some embodiments, this pin configuration is used with any of the above plugs or receptacles.

FIG. 5G is a front view of one embodiment pronged electrical receptacle 501B. In some embodiments, this pin configuration is used with any of the above plugs or receptacles.

FIG. 5H is a front view of one embodiment pronged electrical receptacle 501C. In some embodiments, this pin configuration is used with any of the above plugs or receptacles.

FIG. 5I is a front view of one embodiment pronged electrical receptacle 501D. In some embodiments, this pin configuration is used with any of the above plugs or receptacles.

Figures 6A, 6B, 6C, 6D:
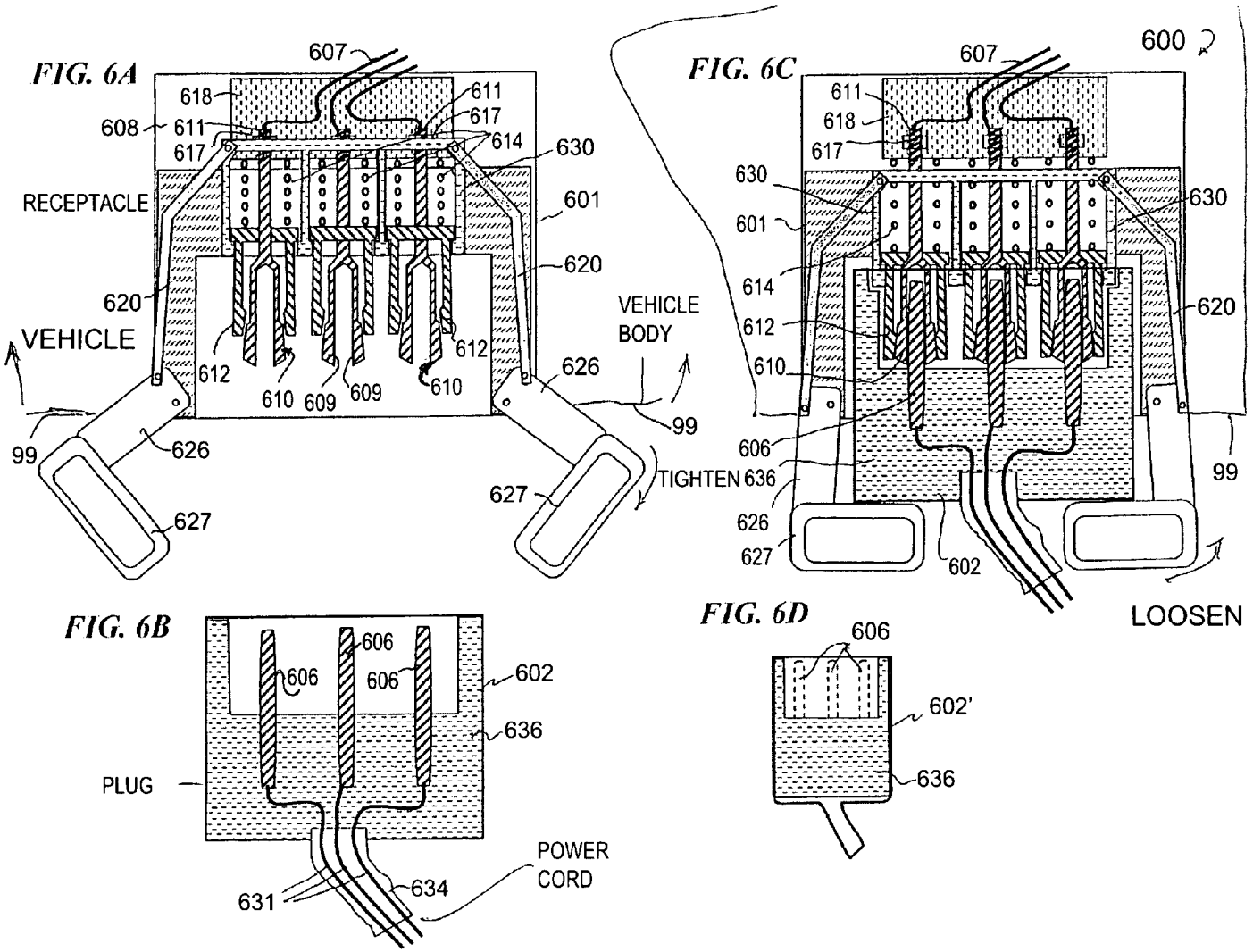
FIG. 6A is a cross-section plan view of compressible-socket socketed receptacle 601 with collet releaser 630.
FIG. 6B is a cross-section plan view of fixed-prong pronged electrical plug 602.
FIG. 6C is a cross-section plan view of electrical connection system 600 having a fixed-prong pronged plug 602 inserted into compressible-socket socketed receptacle 601 with collet releaser 630, where the plug 602 is inserted and clamped in socketed receptacle 601.
FIG. 6D is a plan view of a small version of pronged plug 602'.

FIG. 6A is a cross-section plan view of compressible-socket socketed receptacle 601. In some embodiments, receptacle 601 includes an insulator body 608 holding a plurality of sockets 610 (e.g., 3, 4, 6, or other suitable numbers of sockets), each socket 610 configured to be compressed around a corresponding pin 606 in the plug 602, each socket 610 having a plurality of fingers 609 having tapered outer portions configured to be pushed inward by collet 612 when collet 612 is (independently of the other collets) allowed to be pushed outward (downward in FIG. 6A) by spring 614 when released by collet withdrawer 630, which is driven by push/pull rods 620. Stationary insulator block 618 holds the threaded shaft ends 611 of sockets 610, screwed into nuts 617. In some embodiments, push/pull rods 620 are moved up and down by rotating handles 627 on the ends of arms 626. A plurality of wires 607 extend from inside vehicle 99 to respective ones of the shaft ends 611 of sockets 610.

FIG. 6B is a cross-section plan view of fixed-prong pronged electrical plug 602. Cable 634 extends to a source of power that is to be supplied to the vehicle (e.g., a boat, RV, or other vehicle) when plug 602 is inserted into a corresponding receptacle 601 on the vehicle 99.

Referring back to FIG. 6A, in some embodiments, the handles 627 are extended outward and upward (down in the FIG. 6A, such that push rods 620 push upward) for inserting or withdrawing the plug 602 from the receptacle 601, and handles are pushed downward and inward to the position shown in FIG. 6C, pulling the push rods 620 downward to release collets 612 with individual springs 614 to tighten on the sockets 610 at even and independent pressures around their respective prongs 606 in plug 602. Pulling the handles in the downward direction shown allows the handles to capture and hold the plug 602, allowing handles 627 to also force the plug 602 into a tighter embrace to receptacle 601, while pulling open the handles 627 both loosens the clamping on the pins and allows withdrawal of the plug 602 from receptacle 601. Plug body 636 is made of a suitable insulator, such as plastic material. In some embodiments, the size of plug 602 is as small as an ordinary household electrical cord plug, while in other embodiments, the size is as large as needed for high-current (e.g., hundreds of amps or more) applications needed by a larger vehicle such as an ocean-going ship. The even clamping forces provided by individual springs and collets means that even predetermined clamping forces are applied to each individual pin of the receptacle, resulting in a high-quality electrical connection. In the embodiment shown, there are three columns of sockets 610. In other embodiments, these sockets 610 can be arranged in patterns other than straight rows and columns.

FIG. 6C is a cross-section plan view of electrical connection system 600 having a fixed-prong pronged plug 602, where plug 602 is inserted and clamped in compressible-socket socketed receptacle 601.

FIG. 6D is a plan view of a small version of pronged electrical plug 602'.

Figures 6E, 6F, 6G, 6H, 6I:
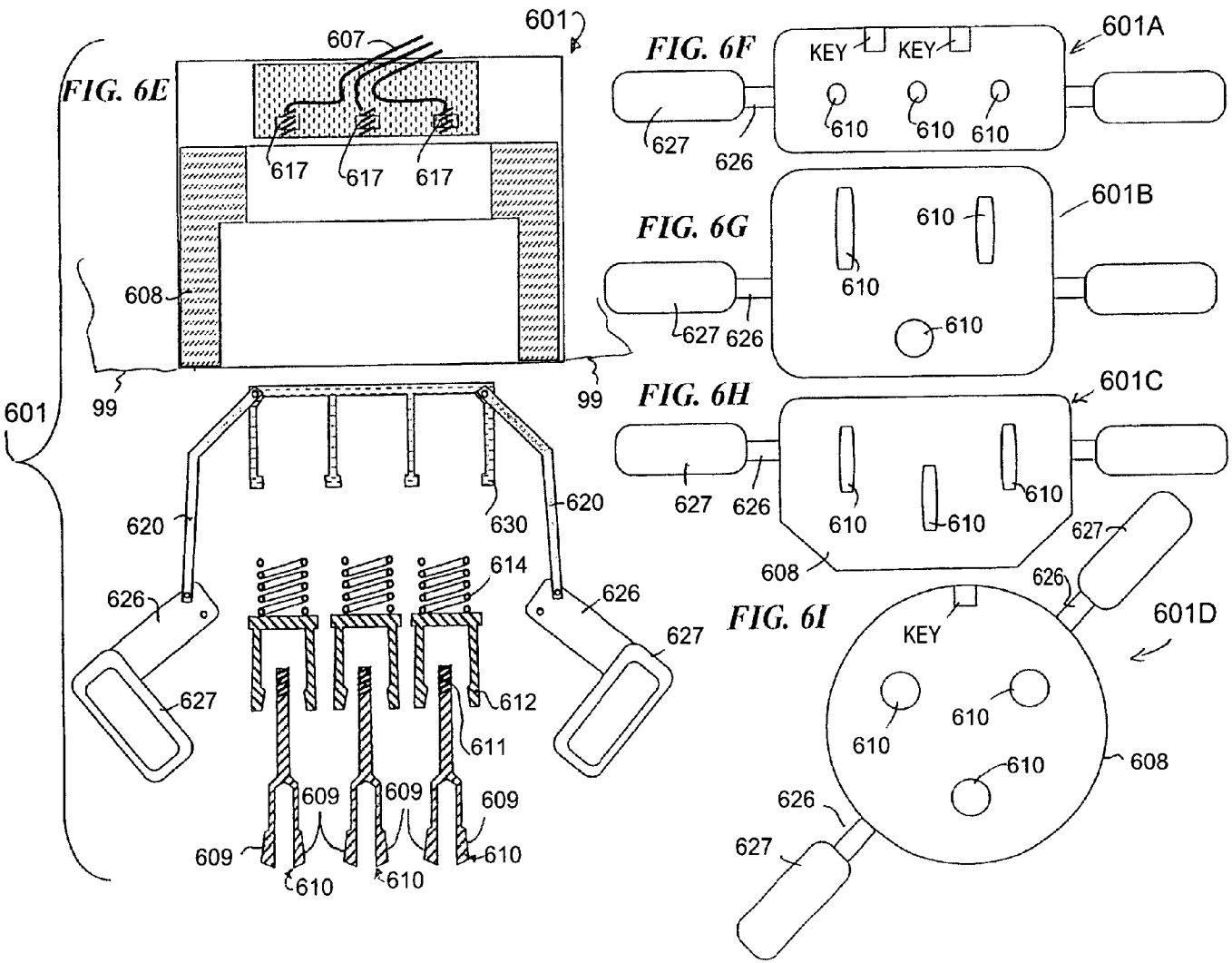
FIG. 6E is an exploded cross-section plan view of compressible-socket socketed electrical receptacle 601 with collet releaser 630.
FIG. 6F is a front view of one embodiment of a compressible-socket electrical receptacle 601A.
FIG. 6G is a front view of one embodiment of a compressible-socket electrical receptacle 601B.
FIG. 6H is a front view of one embodiment of a compressible-socket electrical receptacle 601C.
FIG. 6I is a front view of one embodiment of a compressible-socket electrical receptacle 601D.

FIG. 6E is an exploded cross-section plan view of socketed electrical receptacle 601 with collet releaser 630.

FIG. 6F is a front view of one embodiment of a compressible-socket receptacle 601A.

FIG. 6G is a front view of one embodiment of a compressible-socket receptacle 601B.

FIG. 6H is a front view of one embodiment of a compressible-socket receptacle 601C.

FIG. 6I is a front view of one embodiment of a compressible-socket receptacle 601D.

Figure 7C:
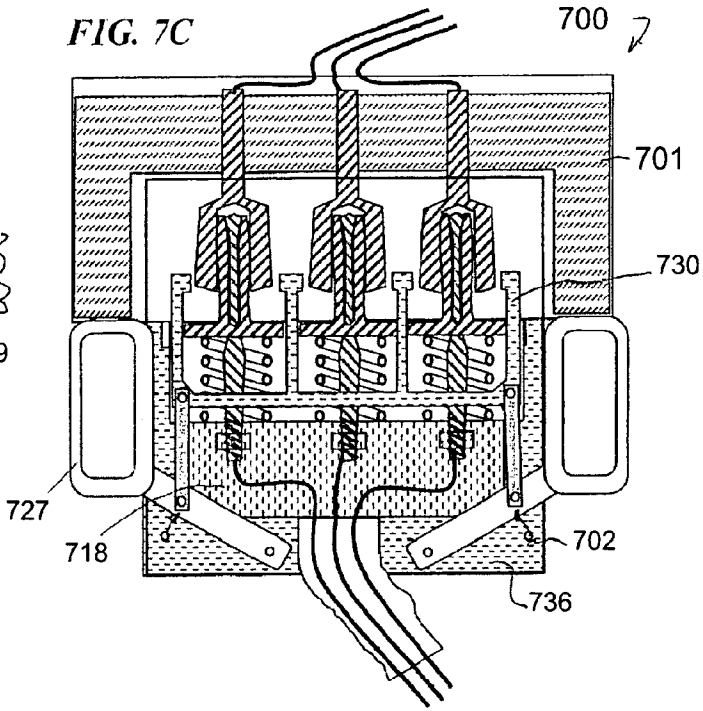
FIG. 7C is a cross-section plan view of electrical connection system 700 having a pronged plug 702 with collet releaser 730, where the plug 702 is inserted and clamped in socketed receptacle 701
Figure 7A:
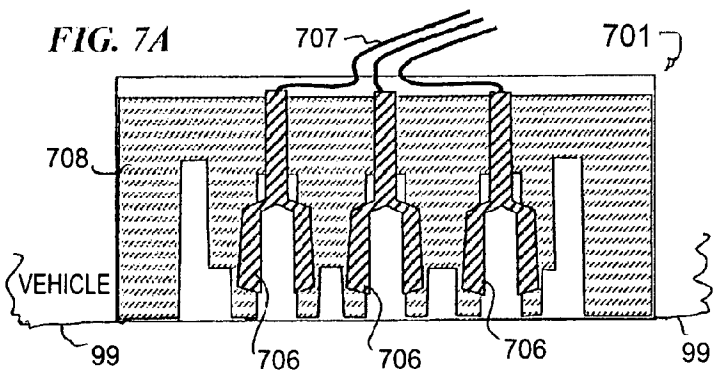
FIG. 7A is a cross-section plan view of socketed receptacle 701.

FIG. 7A is a cross-section plan view of a fixed-socket socketed receptacle 701, which includes a plurality of fixed sockets 706 held in an insulating body 708 and connected to wires 707 that lead electrical power into vehicle 99.

Figure 7B:
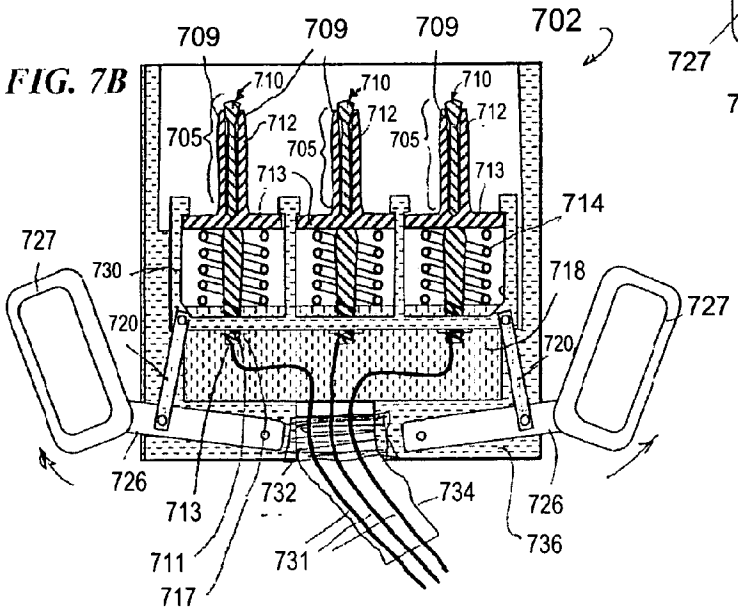
FIG. 7B is a cross-section plan view of pronged electrical plug 702 (having expanding prongs) with collet releaser 730.

FIG. 7B is a cross-section plan view of pronged electrical plug 702 (having expanding prongs) with collet releaser 730. In some embodiments, pronged plug 702 with prong-base releaser 730, where the plug 702 is inserted and clamped in socketed receptacle 701. As shown in FIG. 7C, this system 700 is conceptually the opposite of system 600 of FIG. 6C, in that the plug 702 has expanding pins 705 (instead of contracting sockets 610), and receptacle 701 has fixed sockets 706 (instead of fixed pins 606). Receptacle 701 includes an insulator body 708 holding a plurality of fixed sockets 706 (e.g., three, four, six, or other suitable numbers of sockets 706), each connected to a respective wire 707 leading to interior connections in the vehicle. Plug 702 includes a plurality of expanding pins 705 (e.g., three, four, six, or other suitable numbers of sockets), each expanding pin 705 configured to be expanded outward in a corresponding socket 706 in the receptacle 701, each expanding pin 705 having up-down moving outer portion 712 having a plurality of fingers 709 having tapered outer portions configured to be pushed outward by tapered shaft 710 when shaft base 713 is (independently of the other shaft bases) allowed to be pushed upward by spring 714 when released by shaft withdrawer 730, which is driven by push/pull rods 720. In some embodiments, plug body 736 is made of a suitable insulator, such as plastic material. Stationary insulator block 718 holds the threaded shaft ends 711 of tapered pins 710, screwed into nuts 717. In some embodiments, push rods 720 are hingedly connected to arms 726, which are rotated by handles 727 on the ends of arms 726. A plurality of wires 731 extend from cable holder 732 to respective ones of the wire receiver on shaft ends 713 of expanding pins 710. Cable 734 extends to a source of power that is to be supplied to the vehicle (e.g., a boat, RV, or other vehicle) when plug 702 is inserted into a corresponding receptacle 701 on the vehicle.

FIG. 7C is a cross-section plan view of electrical connection system 700 having a pronged plug 702 with collet releaser 730, where the plug 702 is inserted and clamped in socketed receptacle 701.

Figure 7D:
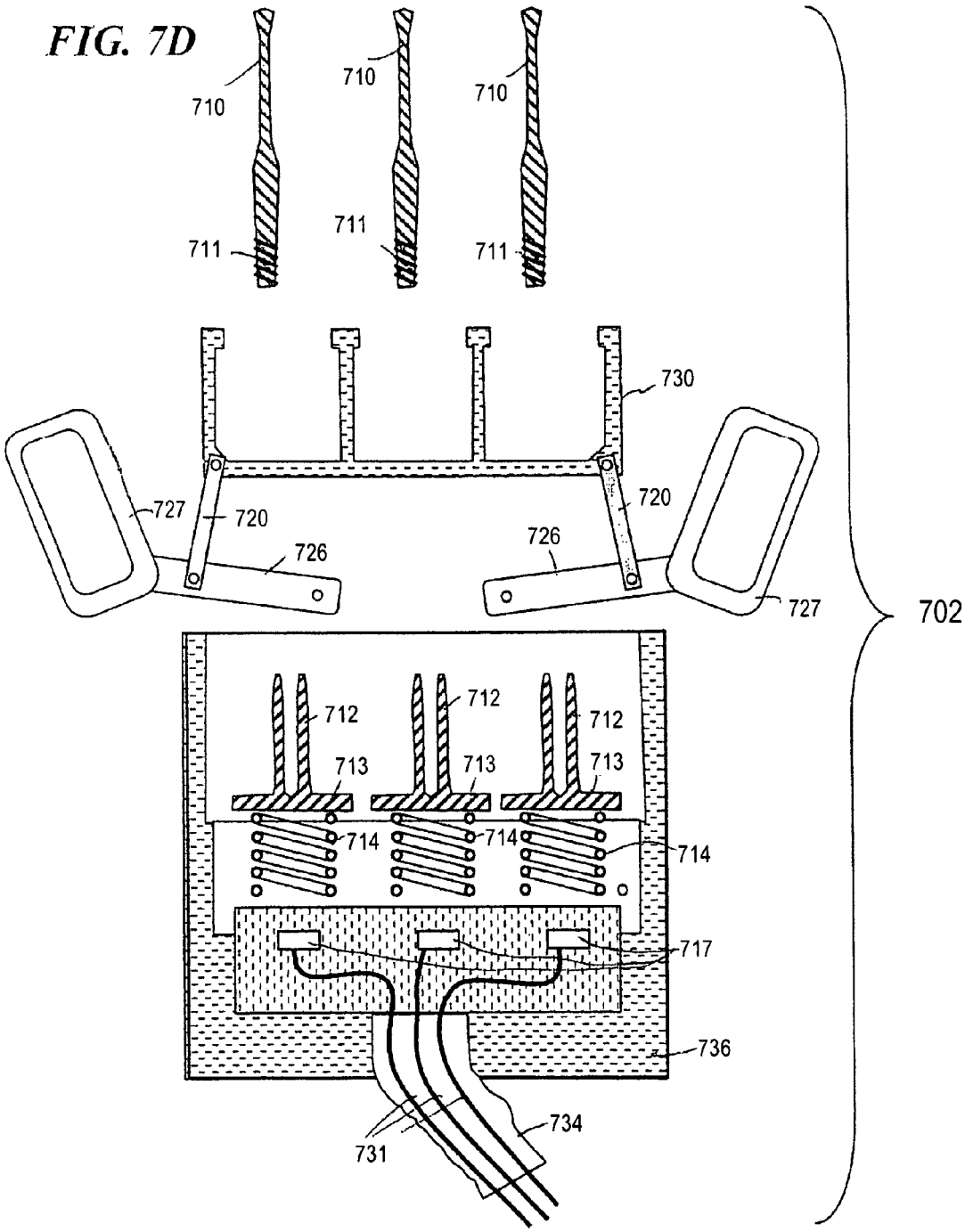
FIG. 7D is an exploded cross-section plan view of pronged electrical plug 702 (having expanding prongs) with collet releaser 730.

FIG. 7D is an exploded cross-section plan view of pronged electrical plug 702 (having expanding prongs) with collet releaser 730.

In summary: The life of the connector can be expected to be longer; the ease of use is dramatically improved; there is means for correctly handling the connector; there is much less tendency for heating damage internal and external to the connector, so expensive installation and assemblies do not have to be repaired, saving money and time for the user; safety is dramatically improved as the failure modes that typically exist are either dramatically reduced or prevented; power conduction is assured so the primary function of supplying power is dramatically improved.

Referring again to FIG. 5B, in some embodiments, the handles 527 are spring loaded (pulled upwards by springs 577), such that the operator must force the handles 527 down into the "release" position in order to plug the plug 502 into the receptacle 501, and when the handles 527 are released, the spring loading of springs 577 automatically lifts and closes the handles 527 to the up, locked, and clamping configuration. This helps prevent an operator from accidentally not forcing the handles into the engaged position, since when the operator releases the handles, they automatically move to the clamping position by springs 577. In some embodiments, such a spring-loaded handle-engaging embodiment is used with other systems described herein.

In some embodiments, the amount of connection force (e.g., the force applied between the fingers 309 of a socket 310 and the prong 306 inserted into that socket when the handles 327 are pushed or pulled to release the spring force (from springs 314) to the collet 312 that tightens the fingers 309 onto the prong 306) is substantially higher than the amount of insertion force (e.g., the force imparted between fingers 309 and prong 306 during insertion of prong 306 into socket 310). For example, in some embodiments, the connection force applied on each prong is at least about 2 times the insertion force. In some embodiments, the connection force applied on each prong is at least about 5 times the insertion force. In some embodiments, the connection force applied on each prong is at least about 10 times the insertion force. In some embodiments, the connection force applied on each prong is at least about 25 times the insertion force. In some embodiments, the connection force applied on each prong is at least about 50 times the insertion force. In some embodiments, the connection force applied on each prong is at least about 100 times the insertion force.

In various embodiments, each of the sockets described above are or can be implemented either in the plug side of the connection or in the receptacle side of the connection, and conversely, each of the prongs described above are or can be implemented either on the receptacle side of the connection or in the plug side of the connection.

In some embodiments, the present invention provides an apparatus that includes a power outlet. In some embodiments, the power outlet (e.g., receptacle 601 of FIG. 6A and FIG. 6B) includes a plurality of power sockets including a first and a second power socket, each socket having a tightening mechanism that includes a plurality of socket fingers, each socket configured to allow a respective prong of a plug to be inserted with low insertion force and then to have the plurality of socket fingers of that socket tightened against the respective prong to an amount of connection force higher than the insertion force, in order to provide the amount of connection force to be set substantially independent of the force applied to the tightening mechanism.

In some embodiments of the power outlet, a low-resistance high-reliability non-locking connection is formed on each prong that permits the plug to be withdrawn without damage upon application of a sufficient tension force on the plug.

In some embodiments of the power outlet, the tightening mechanism includes a spring-loaded collet that surrounds the plurality of fingers.

In some embodiments of the power outlet, the tightening mechanism further includes at least one handle that, when activated, releases the spring-loaded collet to tighten around the plurality of fingers.

In some embodiments of the power outlet, the at least one handle, when deactivated, withdraws the spring-loaded collet from its tightened position around the plurality of fingers.

In some embodiments of the power outlet, the plurality of fingers for each socket includes at least three fingers spaced around a perimeter of the socket, and wherein the tightening mechanism includes a spring-loaded collet that surrounds the plurality of fingers.

In other embodiments, the present invention provides an apparatus that includes a power-cord plug (e.g., plug 100 of FIG. 1A, plug 302 of FIG. 3A, plug 304 of FIG. 3B, plug 306 of FIG. 3C, plug 502 of FIG. 5B and FIG. 5C) having a plurality of power sockets including a first and a second power socket, each having a tightening mechanism, each socket configured to allow a respective prong of an outlet to be inserted with low insertion force and then a plurality of socket fingers to be tightened to a higher connection force, in order to provide an amount of connection force that is set substantially independent of the force applied to the other connections.

In some embodiments of the socketed plug, a low-resistance high-reliability non-locking connection is formed on each prong that permits the plug to be withdrawn from the outlet without substantial damage upon application of a sufficient tension force.

In some embodiments of the socketed plug, the tightening mechanism includes a spring-loaded collet that surrounds the plurality of fingers.

In some embodiments of the socketed plug, the tightening mechanism further includes one or more handles that, when activated, release the spring-loaded collet to tighten around the plurality of fingers.

In some embodiments of the socketed plug, the one or more handles, when deactivated, withdraw the spring-loaded collet from its tightened position around the plurality of fingers.

In some embodiments of the socketed plug, the one or more handles are spring loaded, such that they must be pushed into a deactivated position, in order to withdraw the spring-loaded collet from its tightened position around the plurality of fingers, and when the handles are released, the spring loading moves the handles to a clamping position.

In some embodiments of the socketed plug, the plurality of fingers for each socket includes at least three fingers spaced around a perimeter of the socket, and wherein the tightening mechanism includes a spring-loaded collet that surrounds the plurality of fingers.

In other embodiments, the present invention provides an apparatus that includes a power-cord plug (e.g., plug 402 of FIG. 4, plug 702 of FIG. 7B and FIG. 7C) having a plurality of power prongs including a first and a second power prong, each having a expanding mechanism, each prong configured to insert into a respective fixed socket of an outlet, such that it can be inserted with low insertion force and then tightened to a higher connection force, in order to provide an amount of connection force that is set substantially independent of the force applied to the other connections.

In some embodiments of the pronged plug, a low-resistance high-reliability non-locking connection is formed in each socket by the respective expanding prong also permits the plug to be withdrawn from the outlet without substantial damage upon application of a sufficient tension force.

In some embodiments of the pronged plug, the tightening mechanism includes a spring-loaded expanding shaft having a plurality of fingers surrounding a tapered center shaft.

In some embodiments of the pronged plug, the tightening mechanism further includes one or more handles that, when activated, release the spring-loaded shaft to tighten the plurality of fingers around a tapered shaft in a fixed socket.

In some embodiments of the pronged plug, the one or more handles, when deactivated, withdraw the spring-loaded shaft base from its tightened position around the tapered shaft.

In some embodiments of the pronged plug, the one or more handles are spring loaded, such that they must be pushed into a deactivated position, in order to move each prong to its non-expanded configuration from its expanded-tightened position, and when the handles are released, the spring loading moves the handles to a clamping position where each prong is expanded in circumference.

In some embodiments of the pronged plug, the tightening mechanism includes an expanding shaft having a plurality of fingers surrounding a tapered spring-loaded center shaft, wherein the plurality of fingers for each prong includes at least three fingers spaced around a perimeter of the center shaft.

In some embodiments, the present invention provides a method for connecting to a power outlet. In some embodiments, the power outlet (e.g., receptacle 601 of FIG. 6A and FIG. 6B) includes a plurality of power sockets including a first and a second power socket, each socket having a tightening mechanism that includes a plurality of socket fingers. The method includes inserting respective prongs of a plug with low insertion force into the outlet, and tightening the plurality of socket fingers of each socket against the respective prong to an amount of connection force higher than the insertion force, in order to provide the amount of connection force to be set substantially independent of the force applied to the tightening mechanism.

Some embodiments of the power-outlet method further include forming a low-resistance high-reliability non-locking connection on each prong, and permitting the plug to be withdrawn without damage upon application of a sufficient tension force on the plug.

Some embodiments of the power-outlet method further include releasing a spring-loaded collet that surrounds the plurality of fingers so the collet squeezes the fingers against the respective prong. Some embodiments of the power-outlet method further include coupling at least one handle to the spring-loaded collet such that, when activated, the at least one handle releases the spring-loaded collet to tighten around the plurality of fingers.

Some embodiments of the power-outlet method further include connecting the at least one handle to the collet such that, when deactivated, the at least one handle withdraws the spring-loaded collet from its tightened position around the plurality of fingers.

In some embodiments of the power outlet method, the plurality of fingers for each socket includes at least three fingers spaced around a perimeter of the socket, and wherein the tightening includes releasing a spring-loaded collet that surrounds the plurality of fingers.

In other embodiments, the present invention provides a method for electrically connecting a power-cord plug (e.g., plug 100 of FIG. 1A, plug 302 of FIG. 3A, plug 304 of FIG. 3B, plug 306 of FIG. 3C, plug 502 of FIG. 5B and FIG. 5C) to a receptacle, the plug having a plurality of power sockets including a first and a second power socket, each having a tightening mechanism. This method includes inserting a respective prong of an outlet to a corresponding socket of the receptacle with low insertion force, and then tightening a plurality of socket fingers to a higher connection force, in order to provide an amount of connection force that is set substantially independent of the force applied to the other connections.

Some embodiments of the socketed-plug method further include forming a low-resistance high-reliability non-locking connection on each prong that permits the plug to be withdrawn from the outlet without substantial damage upon application of a sufficient tension force.

In some embodiments of the socketed-plug method, the tightening mechanism includes a spring-loaded collet that surrounds the plurality of fingers, and the method further includes releasing the spring-loaded collet to tighten the fingers.

In some embodiments of the socketed-plug method, the tightening mechanism further includes one or more handles that, when activated, the method further includes releasing the spring-loaded collet to tighten around the plurality of fingers.

In some embodiments of the socketed-plug method, the one or more handles, when deactivated, the method further includes withdrawing the spring-loaded collet from its tightened position around the plurality of fingers.

In some embodiments of the socketed-plug method, the one or more handles are spring loaded, and the method includes manually pushing the handles into a deactivated position, in order to withdraw the spring-loaded collet from its tightened position around the plurality of fingers, and when the handles are released, the method further includes automatically moving the spring-loaded handles to a clamping position.

In some embodiments of the socketed-plug method, the plurality of fingers for each socket includes at least three fingers spaced around a perimeter of the socket, and the method further includes spring loading the collet-tightening mechanism that surrounds the plurality of fingers.

In other embodiments, the present invention provides a method for electrically connecting a power-cord plug (e.g., plug 402 of FIG. 4, plug 702 of FIG. 7B and FIG. 7C) the plug having a plurality of power prongs including a first and a second power prong, each having a expanding mechanism. This method includes inserting each prong into a respective fixed socket of an outlet, such that it can be inserted with low insertion force and then tightened to a higher connection force, in order to provide an amount of connection force that is set substantially independent of the force applied to the other connections.

In some embodiments of the pronged plug method, the method further includes forming a low-resistance high-reliability non-locking connection in each socket by the respective expanding prong, and permitting the plug to be withdrawn from the outlet without substantial damage upon application of a sufficient tension force.

In some embodiments of the pronged plug method, the method further includes spring loading the tightening mechanism that includes an expanding shaft having a plurality of fingers surrounding a tapered center shaft.

In some embodiments of the pronged plug method, the tightening mechanism further includes one or more handles that, when activated, the method further includes releasing the spring-loaded shaft to tighten the plurality of fingers around a tapered shaft in a fixed socket.

In some embodiments of the pronged plug method, the one or more handles, when deactivated, the method further includes withdrawing the spring-loaded shaft base from its tightened position around the tapered shaft.

In some embodiments of the pronged plug method, the one or more handles are spring loaded, such that method includes manually pushing the handles into a deactivated position, in order to move each prong to its non-expanded configuration from its expanded-tightened position, and when the handles are released, the method further includes moving the spring-loaded handles to a clamping position where each prong is expanded in circumference.

In some embodiments of the pronged plug method, the tightening mechanism includes an expanding shaft having a plurality of fingers surrounding a tapered spring-loaded center shaft, the method further includes spacing the at least three fingers for each around a perimeter of the center shaft.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A power outlet comprising:

a plurality of power sockets including a first and a second power socket, each socket having a tightening mechanism that includes a plurality of socket fingers, each socket configured to allow a respective prong of a plug to be inserted with low insertion force and then to have the plurality of socket fingers of that socket tightened against the respective prong to an amount of connection force higher than the insertion force, in order to provide the amount of connection force to be set substantially independent of the force applied to the tightening mechanism, wherein a low-resistance high-reliability non-locking connection is formed on each prong that permits the plug to be withdrawn without damage upon application of a sufficient tension force on the plug.

2. A power outlet comprising:

a plurality of power sockets including a first and a second power socket, each socket having a tightening mechanism that includes a plurality of socket fingers, each socket configured to allow a respective prong of a plug to be inserted with low insertion force and then to have the plurality of socket fingers of that socket tightened against the respective prong to an amount of connection force higher than the insertion force, in order to provide the amount of connection force to be set substantially independent of the force applied to the tightening mechanism, wherein the tightening mechanism includes a spring-loaded collet that surrounds the plurality of fingers.

3. The outlet of claim 2, wherein the tightening mechanism further includes at least one handle that, when activated, releases the spring-loaded collet to tighten around the plurality of fingers.

4. The outlet of claim 3, wherein the spring-loaded collet upon release tightens in a tightened position around the plurality of fingers, and wherein the at least one handle, when deactivated, withdraws the spring-loaded collet from the tightened position around the plurality of fingers.

5. A power outlet comprising:

a plurality of power sockets including a first and a second power socket, each socket having a tightening mechanism that includes a plurality of socket fingers, each socket configured to allow a respective prong of a plug to be inserted with low insertion force and then to have the plurality of socket fingers of that socket tightened against the respective prong to an amount of connection force higher than the insertion force, in order to provide the amount of connection force to be set substantially independent of the force applied to the tightening mechanism, wherein the plurality of fingers for each socket includes at least three fingers spaced around a perimeter of the socket, and wherein the tightening mechanism includes a spring-loaded collet that surrounds the plurality of fingers.

6. An apparatus comprising:

a power-cord plug configured to be connected to a free end of a power cord, the power-cord plug comprising:

a plurality of power sockets including a first and a second power socket, each having a tightening mechanism, each socket configured to allow a respective prong of an outlet to be inserted with low insertion force and then a plurality of socket fingers to be tightened to a higher connection force, in order to provide an amount of connection force to said each socket that is set substantially independent of the force applied to other ones of the plurality of power sockets, wherein a low-resistance high-reliability non-locking connection is formed on each prong that permits the plug to be withdrawn from the outlet without substantial damage upon application of a sufficient tension force.

7. An apparatus comprising:

a power-cord plug configured to be connected to a free end of a power cord, the power-cord plug comprising:

a plurality of power sockets including a first and a second power socket, each having a tightening mechanism, each socket configured to allow a respective prong of an outlet to be inserted with low insertion force and then a plurality of socket fingers to be tightened to a higher connection force, in order to provide an amount of connection force to said each socket that is set substantially independent of the force applied to other ones of the plurality of power sockets, wherein the tightening mechanism includes a spring-loaded collet that surrounds the plurality of fingers.

8. The apparatus of claim 7, wherein the tightening mechanism further includes one or more handles that, when activated, release the spring-loaded collet to tighten in a tightened position around the plurality of fingers.

9. The apparatus of claim 8, wherein the one or more handles, when deactivated, withdraw the spring-loaded collet from the tightened position around the plurality of fingers.

10. The apparatus of claim 8, wherein the one or more handles are spring loaded, such that the one or more handles must be pushed into a deactivated position, in order to withdraw the spring-loaded collet from the tightened position around the plurality of fingers, and when the handles are released, the spring loading moves the handles to a clamping position.

11. An apparatus comprising:

a power-cord plug configured to be connected to a free end of a power cord, the power-cord plug comprising:

a plurality of power sockets including a first and a second power socket, each having a tightening mechanism, each socket configured to allow a respective prong of an outlet to be inserted with low insertion force and then a plurality of socket fingers to be tightened to a higher connection force, in order to provide an amount of connection force to said each socket that is set substantially independent of the force applied to other ones of the plurality of power sockets, wherein the plurality of fingers for each socket includes at least three fingers spaced around a perimeter of the socket, and wherein the tightening mechanism includes a spring-loaded collet that surrounds the plurality of fingers.

12. An apparatus comprising:

a power-cord plug configured to be connected to a free end of a power cord, the power-cord plug comprising:

a plurality of power prongs including a first and a second power prong, each having an expanding mechanism, each prong configured to insert into a respective fixed socket of an outlet, such that each prong can be inserted with low insertion force and then tightened to a higher connection force, in order to provide an amount of connection force to said each prong that is set substantially independent of the force applied to other ones of the plurality of power prongs, wherein a low-resistance high-reliability non-locking connection formed in each socket by a respective expanding prong also permits the plug to be withdrawn from the outlet without substantial damage upon application of a sufficient tension force.

13. An apparatus comprising:

a power-cord plug configured to be connected to a free end of a power cord, the power-cord plug comprising:

a plurality of power prongs including a first and a second power prong, each having an expanding mechanism, each prong configured to insert into a respective fixed socket of an outlet, such that each prong can be inserted with low insertion force and then tightened to a higher connection force, in order to provide an amount of connection force to said each prong that is set substantially independent of the force applied to other ones of the plurality of power prongs, wherein the expanding mechanism includes a spring-loaded expanding shaft having a plurality of fingers surrounding a tapered center shaft.

14. The apparatus of claim 13, wherein the expanding mechanism further includes one or more handles that, when activated, release the spring-loaded shaft to tighten the plurality of fingers in an expanded-tightened position around a tapered shaft in a fixed socket.

15. The apparatus of claim 14, wherein the one or more handles, when deactivated, withdraw the spring-loaded shaft from the expanded-tightened position around the tapered shaft.

16. The apparatus of claim 14, wherein the one or more handles are spring loaded, such that the one or more handles must be pushed into a deactivated position, in order to move each prong to a non-expanded configuration from the expanded-tightened position, and wherein when the handles are released, the spring loading moves the handles to a clamping position where each prong is expanded in circumference.

17. The apparatus of claim 13, wherein the tightening mechanism includes an expanding shaft having a plurality of fingers surrounding a tapered spring-loaded center shaft, wherein the plurality of fingers for each prong includes at least three fingers spaced around a perimeter of the tapered center shaft.

* * * * *